United States Patent [19]

Yoshida et al.

[11] Patent Number: 5,066,571

[45] Date of Patent: Nov. 19, 1991

[54] METHOD FOR PROCESSING A SILVER HALIDE COLOR PHOTOSENSITIVE MATERIAL

[75] Inventors: Kazuaki Yoshida; Takatoshi Ishikawa, both of Kanagawa, Japan

[73] Assignee: Fuji Photo Film Co., Ltd., Kanagawa, Japan

[21] Appl. No.: 416,690

[22] Filed: Oct. 3, 1989

[30] Foreign Application Priority Data

Oct. 3, 1988 [JP] Japan ..... 63-249250

[51] Int. Cl.[5] ..... G03C 5/24

[52] U.S. Cl. ..... 430/489; 430/268; 430/434; 430/484; 430/486; 430/490

[58] Field of Search ..... 430/268, 399, 486, 489, 430/490, 434, 447, 448, 484

[56] References Cited

U.S. PATENT DOCUMENTS

| | | | |
|---|---|---|---|
| 4,159,245 | 6/1979 | Matsushita et al. | 430/399 |
| 4,797,351 | 1/1989 | Ishikawa et al. | 430/399 |
| 4,897,339 | 1/1990 | Andoh et al. | 430/484 |
| 4,914,009 | 4/1990 | Ueda et al. | 430/489 |
| 4,933,265 | 6/1990 | Inoue et al. | 430/489 |

FOREIGN PATENT DOCUMENTS

| | | |
|---|---|---|
| 0312984 | 4/1989 | European Pat. Off. . |
| 1-05948 | 4/1989 | Japan . |
| 1-16639 | 5/1989 | Japan . |

OTHER PUBLICATIONS

A Derwent Abstract of Japan No. A1-105948 is attached.

*Primary Examiner*—Hoa Van Le

*Attorney, Agent, or Firm*—Sughrue, Mion, Zinn Macpeak & Seas

[57] ABSTRACT

A method for processing a silver halide color photosensitive material is disclosed.

The method comprises developing a color photographic light-sensitive material composed of a support having thereon at least one light-sensitive silver halide emulsion layer containing a silver halide comprising at least 98 mol % silver chloride;

in a color developer solution comprising a primary amine color developing agent, and having a chloride ion concentration of from $4\times10^{-2}$ to $1\times10^{-1}$ mol/l, and a bromide ion concentration of from $5\times10^{-5}$ to $5\times10^{-4}$ mol/l.

When used in rapid processing methods, the method according to the invention prevents fogging streaks, and provides high maximum density and low minimum density images.

14 Claims, No Drawings

METHOD FOR PROCESSING A SILVER HALIDE COLOR PHOTOSENSITIVE MATERIAL

FIELD OF THE INVENTION

The present invention relates to a method for processing silver halide color photographic photosensitive materials. More particularly, the invention relates to a development processing method which uses a high silver chloride photographic photosensitive material, providing excellent development characteristics and desilvering characteristics.

BACKGROUND OF THE INVENTION

The trends to shorter delivery times for finished work and reduction of laboratory operations in photographic processing of color photographic photosensitive material in recent years have required processing time to be shortened. The usual methods of shortening the times required for different processing stages are to raise the temperature and to increase the amount of replenishment, and there have also been proposed many methods of stronger agitation and methods in which various types of accelerators are added.

To increase the speed of color development and/or reduce replenishment amounts, a method is known for processing color photographic photosensitive materials containing silver chloride emulsions instead of the silver bromide emulsions or silver iodide emulsions of popular conventional use. For example, PCT WO-87-04534 discloses a method for rapid processing of high silver chloride color photographic photosensitive material with a color development solution which contains essentially no sulfite or benzyl alcohol.

However, it has been found that streaky fogging occurs when development processing is performed by this method in an automatic paper development unit. It is surmized that this is "in-solution pressure sensitization streaking" in which streaky fogging occurs because the photosensitive material is bruised and pressure sensitized when it comes into contact with rollers in the development tank of an automatic development unit.

It has also been found that in continuous processing, fluctuation in photographic characteristics (especially the minimum density) occurs and there is considerable staining of the white background.

Thus, rapid development processing using high silver chloride color photographic photosensitive materials has the major problems of pressure sensitization fogging in the solution and fluctuation in photographic characteristics, and there is therefore a strong demand for resolution of these problems.

Use of the organic antifoggants disclosed in JP-A-58-95345 and JP-A-59-232342 (the term "JP-A" as used herein means an "unexamined published Japanese patent application") is known as a means for reducing fluctuation in photographic characteristics (and especially fogging) that occurs during continuous processing by rapid processing methods using high silver chloride color photographic photosensitive materials. However, these antifoggants have insufficient fogging prevention effects and fail to prevent pressure sensitization streaks in solutions, or the increase in the minimum density as continuous processing proceeds, and it has been found that when large amounts are used there is a decrease in the maximum density.

JP-A-61-70552 discloses a method for reducing the amount of development solution replenishment in which use is made of high silver chloride color photographic photosensitive material and addition of replenishment solution is made in an amount such that there is no overflow to the development bath during development. JP-A-63-106655 teaches a method in which, in order to stabilize processing, a silver halide color photographic photosensitive material whose silver halide emulsion layers have a high silver chloride content is developed with a color development solution containing a chloride at higher than a set concentration and a hydroxylamine-based compound.

JP-A-63-106655 discloses a method of processing 70 mol % or more silver chloride photosensitive material using a development solution in which $2\times10^{-2}$ moles or more of a chloride have been included.

With these methods, however, the above-described pressure sensitization streaks occur in processing by an automatic development unit, along with fluctuation in photographic characteristics during continuous processing, and these methods fail to resolve the problems noted above.

SUMMARY OF THE INVENTION

A first object of the invention is to provide a rapid development processing method in which a high silver chloride color photographic photosensitive material is used, in which the occurrence of streaky fogging is prevented.

A second object of the invention is to provide a development processing method for a high silver chloride color photographic photosensitive material providing excellent photographic characteristics, i.e., the maximum density is high and the minimum density is low in rapid processing, and there is marked inhibition of fluctuation of photographic characteristics (especially the minimum density) during continuous processing.

It has now been found that these and other objects of the invention are achieved by a method for processing a silver halide color photosensitive material which comprises developing a color photographic lightsensitive material comprising a support having thereon at least one light-sensitive silver halide emulsion layer containing a silver halide comprising at least 80 mol % silver chloride;

in a color developer solution comprising a primary amine color developing agent, and having a chloride ion concentration of from $3.5\times10^{-2}$ to $1.5\times10^{-1}$ mol/l, and a bromide ion concentration of from $3.0\times10^{-5}$ to $1.0\times10^{-3}$ mol/l.

DETAILED DESCRIPTION OF THE INVENTION

Chloride ions are well-known as an agent for preventing fogging but their effects are slight and even if they are used in large quantities they fail to completely prevent an increase in fogging during the course of continuous processing or streaky fogging that occurs in development by an automatic development unit, and they can even have the undesirable effect of slowing down development and lowering the maximum density.

Bromide ions too are well-known as an agent for preventing fogging. Although, depending on the amount added, they can prevent fogging during continuous processing and streaky pressure fogging, they are not suitable for practical use since they inhibit development and cause a lowering of the maximum density and sensitivity.

As the result of much investigation, the present inventors have discovered that if processing is performed using a high silver chloride photosensitive material with a silver chloride content of 80 mol % or more and a color development solution containing $3.5\times10^{-2}$ to $1.5\times10^{-1}$ mol/l of chloride ions and $3.0\times10^{-5}$ to $1.0\times10^{-3}$ mol/l of bromide ions, occurrence of streaky pressure fogging in processing by an automatic development unit and fluctuation in photographic characteristics (especially the minimum density) in the course of continuous processing are prevented without a loss of maximum density, and also the amount of residual silver is markedly reduced.

These effects are not observed with either bromide ions or chloride ions used alone, and it is unpredictable and surprising that they are achieved in combination within the concentrations of the invention.

Without being bound in any way by theory, it is considered likely that streaky pressure fogging which occurs in automatic development unit processing is the result of intensification and formation of fogging nuclei in portions that have been subjected to pressure when excessive pressure is imposed on photosensitive material in a color development solution following exposure. This fogging is different from fogging in the form of density resulting from development of unexposed portions.

It is considered likely that the inclusion of suitable amounts of bromide ions and chloride ions in the development solution in the invention effects selective inhibition of fogging nuclei, and thus inhibits fogging without slowing down development or reducing the maximum density or speed. This selective development inhibition effect that is caused by combinations of bromide ions and chloride ions cannot be explained simply in terms of a change in the silver ion reduction potential due to the presence of halogens and it is considered likely that the phenomenon is considerably affected by the way in which the bromide ions and chloride ions are adsorbed on silver halide grains.

The inhibition of fluctuation of photographic characteristics during continuous processing cannot be explained simply as inhibition of this fluctuation through a balance between high development activity brought about by use of a high silver chloride emulsion and a reduction in activity due to the presence of suitable amounts of bromide ions, i.e., through high activity-high inhibition type development.

With respect to the marked inhibition of desilvering faults, it is known that high silver chloride emulsions are liable to cause desilvering faults. The present inventors have discovered that the cause of desilvering faults is the formation of silver sulfite. It is considered that the presence of suitable amounts of bromide ions and chloride ions in the development solution changes the manner in which halogens are adsorbed on developed silver and thereby inhibits the formation of silver sulfite.

The invention will now be described in greater detail.

The silver halide emulsion is composed substantially of silver chloride. What is meant here by substantially, is that the silver chloride content relative to the total amount of silver halide is 80 mol % or more and preferably 95 mol % or more and still more preferably 98 mol % or more. For rapidity, the higher the silver chloride content the better.

For rapid development, desilvering characteristics and prevention of pressure sensitization streaks, it is preferred that the amount of coated silver in the silver halide photosensitive material of the invention be not more than 0.80 g/m$^2$. This not only reduces the amount of silver but also reduces the film thickness. A coated silver quantity of 0.75 g/m$^2$ or less is more preferred, 0.65 g/m$^2$ or less being particularly preferred. The lower limit is suitably 0.3 g/m$^2$.

It is necessary that the color development solution have a chloride ion concentration of $3.5\times10^{-2}$ to $1.5\times10^{-1}$ mol/l and preferably the concentration is $4\times10^{-2}$ to $1.0\times10^{-1}$ mol/l. A chloride ion concentration of more than $1.5\times10^{-1}$ mol/l has the drawback that it slows down development and fails to provide rapidity and a high maximum density. At less than $3.5\times10^{-2}$ mol/l, it is not possible to prevent streaky pressure fogging, in addition to which there is considerable fluctuation in photographic characteristics (especially the minimum density) during the course of continuous processing and the amount of residual silver is large.

It is necessary that the color development solution have a bromide ion concentration of $3.0\times10^{-5}$ to $1.0\times10^{-3}$ mol/l and preferably the concentration is $5.0\times10^{-5}$ to $5\times10^{-4}$ mol/l. If the bromide ion concentration is more than $1.0\times10^{-3}$ mol/l, development is slowed down and there is a loss of the maximum density and speed. If it is less than $3.0\times10^{-5}$ mol/l, it is not possible to prevent streaky pressure fogging and it is not possible to prevent desilvering faults or fluctuation in photographic characteristics (especially the minimum density) as continuous processing proceeds.

The chloride ions and bromide ions may be added directly to the development solution or may be eluted from the photosensitive material into the development solution. A suitable measure for increasing the amount eluted from sensitive material is to reduce the amount of development solution replenishment.

Sodium chloride, potassium chloride, ammonium chloride, nickel chloride, magnesium chloride, manganese chloride, calcium chloride and cadmium chloride can be used as chloride ion donor substances when direct addition to the color development solution is made and sodium chloride and potassium chloride are preferred.

These may be supplied in the form of salts having counter ion of fluorescent brightness that are added to the development solution. Sodium bromide, potassium bromide, ammonium bromide, lithium bromide, calcium bromide, magnesium bromide, manganese bromide, nickel bromide, cadmium bromide, cerium bromide and thallium bromide may be used as bromide ion donor substances, and preferred are potassium bromide and sodium bromide.

In cases where the ions are eluted from the photosensitive material into the development solution, both the chloride ions and the bromide ions may be supplied from an emulsion or they may be supplied from a portion other than an emulsion.

From the point of view of processing stability during continuous processing and prevention of streaky pressure fogging, the color development solution in the invention preferably contains substantially no sulfite ions, this can be achieved by not using the development solution for a long time, so as to suppress deterioration of the development solution. Also, physical means such as use of a floating cover or reduction of the degree of opening of the development both can be used, or controlling the development solution temperature or chemical means such as addition of organic preservatives in order to suppress air oxidation effects. Of such measures, the use of organic preservatives is advantageous in that it is easy.

What is meant by "organic preservative" in the present invention is any organic compound which reduces the rate of deterioration of primary aromatic amine color developing agents when added to color photographic photosensitive material processing solutions. These include organic compounds capable of preventing the oxidation of color developing agents by air, and particularly effective organic preservatives include hydroxylamine derivatives (hereinafter excluding hydroxylamine), hydroxamic acids, hydrazines, hydrazides, phenols, α-hydroxyketones α-aminoketones, sugars, monoamines, diamines, polyamines, quaternary ammonium salts, nitroxy radicals, alcohols, oximes, diamide compounds and condensed ring type amines. Such substances are disclosed in, e.g., JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-170642, JP-A-63-44657 and JP-A-63-44656, U.S. Pat. Nos. 3,615,503 and 2,494,903, JP-A-52-143020 and JP-B-48-30496 (the term "JP herein means an "examined Japanese patent publication).

General formulas and specific examples of preferred organic preservatives are given below but the invention is not to be construed as being limited to these.

It is desirable that the compounds noted below be added to a color development solution to amounts such that their concentration is 0.005 to 0.5 mol/l, preferably 0.03 to 0.1 mol/l.

Addition of hydroxylamine derivatives and/or hydrazine derivatives is particularly preferred.

Compounds representable by formula (I) are preferred hydroxylamine derivatives:

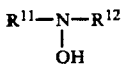

(I)

In the formula, $R^{11}$ and $R^{12}$, which may be the same or different, each represents hydrogen substituted or unsubstituted $C_{1-10}$ alkyl groups, substituted or unsubstituted $C_{1-10}$ alkenyl groups, substituted or unsubstituted $C_{6-10}$ aryl groups or substituted or unsubstituted heteroaromatic group, provided that $R^{11}$ and $R^{12}$ are not both hydrogen, and they may be linked to form a hetero ring together with the nitrogen atom. Hetero ring structures formed include 5- to 6-membered rings, and may contain carbon, hydrogen, halogen, oxygen, nitrogen or sulfur atoms. The rings may be saturated or unsaturated.

The case where $R^{11}$ and $R^{12}$ are alkyl groups or alkenyl groups is preferred, and the number of carbon atoms in each is preferably 1 to 10, 1 to 5 being particularly preferred. Examples of nitrogen-containing hetero rings in which $R^{11}$ and $R^{12}$ are linked include piperidyl, pyrrolidilyl, N-alkylpiperazyl, morpholyl, indolinyl and benztriazole groups.

Preferred $R^{11}$ and $R^{12}$ substituents are hydroxyl, alkoxy, alkyl sulfonyl, arylsulfonyl, amino, carboxyl, cyano, sulfo, nitro and amino groups.

The following specific hydroxylamine derivatives may be used, but the present invention is not to be construed as being limited thereto.

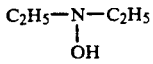

I-1

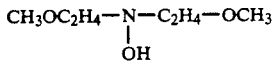

I-2

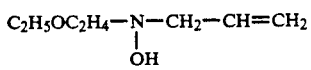

I-3

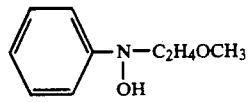

I-4

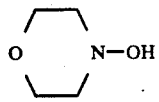

I-5

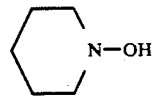

I-6

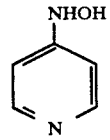

I-7

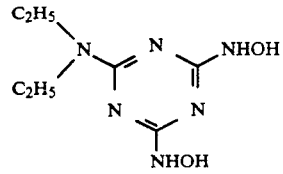

I-8

The following are preferred as hydrazines and hydrazides.

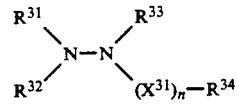

(II)

In the formula, $R^{31}$, $R^{32}$ and $R^{33}$, which may be the same or different each represents hydrogen atoms or substituted or unsubstituted $C_{1-10}$ alkyl, $C_{6-10}$ aryl or heterocyclic groups, and $R^{34}$ represents a hydroxyl, hydroxyamino, substituted or unsubstituted alkyl, aryl, heterocyclic, alkoxy, aryloxy, carbamoyl or amino group. The heterocyclic groups are 5–6 membered rings including C, H, 0, N, S and halogen atoms, and may be either saturated or unsaturated $X^{31}$ represents a divalent group selected from —CO—, —$SO_2$— and

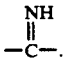

n is 1 or 0. In particular, when n is 0, $R^{34}$ is a group selected from among alkyl aryl and heterocyclic groups and $R^{33}$ and $R^{34}$ may be linked to form a hetero ring.

In formula (II), $R^{31}$, $R^{32}$ and $R^{33}$ are preferably hydrogen or $C_{1-10}$ alkyl groups, and in most preferably $R^{31}$ and $R^{32}$ are hydrogen.

In formula (II), $R^{34}$ is preferably an $C_{1-10}$ alkyl, $C_{6-10}$ aryl, $C_{1-10}$ alkoxy, $C_{1-10}$ carbamoyl or amino group, and an alkyl or substituted alkyl group is particularly preferred. Preferred alkyl group substituents include carboxyl, sulfo, nitro, amino and phosphono groups. $X^{31}$ is preferably —CO— or —$SO_2$ is most preferably —CO—.

Specific examples of compounds of formula (II) are as follows, but the present invention is not to be construed as being limited thereto.

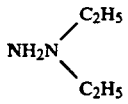
II-1

$NH_2NH(CH_2)_4SO_3H$ II-2

$NH_2NH(CH_2)_2OH$ II-3

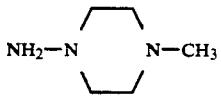
II-4

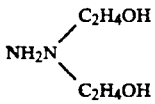
II-5

$NH_2NHCOCH_3$ II-6

$NH_2NHCOOC_2H_5$ II-7

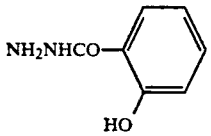
II-8

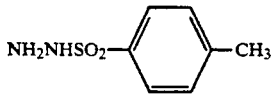
II-9

$NH_2NHCONH_2$ II-10

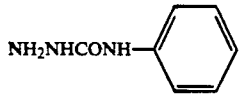
II-11

$NH_2NHSO_3H$ II-12

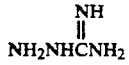
II-13

$NH_2NHCOCONHNH_2$ II-14

$NH_2NHCH_2CH_2CH_2SO_3H$ II-15

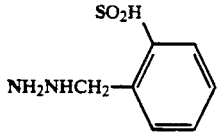
II-16

-continued

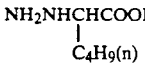
II-17

$NH_2NHCH_2CH_2COOH$ II-18

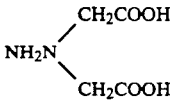
II-19

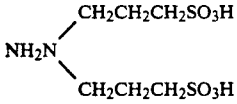
II-20

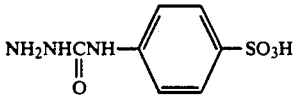
II-21

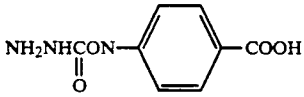
II-22

For improving the stability of the color development solution and improving the stability of presentation in continuous processing, it is preferable to use compounds represented by formula (I) or (II) in combination with amines represented by formula (III) or (IV).

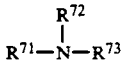
(III)

In the formula $R^{71}$, $R^{72}$ and $R^{73}$, which may be the same or different, each represents hydrogen or $C_{1-10}$ alkyl, $C_{1-10}$ alkenyl, $C_{6-10}$ aryl or $C_{6-10}$ aralkyl groups or heterocyclic groups. $R^{71}$ and $R^{72}$ or $R^{71}$ and $R^{73}$ or $R^{72}$ and $R^{73}$ may be linked to form a nitrogen-containing heterocyclic ring.

$R^{71}$, $R^{72}$ and $R^{73}$ here may have substituents. Hydrogen and alkyl groups are particularly preferred as $R^{71}$, $R^{72}$ and $R^{73}$. Examples of suitable substituents include, hydroxyl groups, sulfo groups, carboxyl groups, halogen atoms, nitro groups and amino groups Specific compounds represented by formula (III) include the following, but the present invention is not to be construed as being limited thereto.

$N(CH_2CH_2OH)_3$ III-1

$H_2NCH_2CH_2OH$ III-2

$HN(CH_2CH_2OH)_2$ III-3

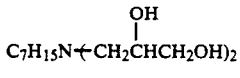
III-4

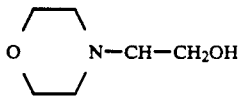
III-5

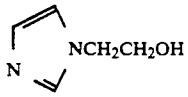
III-6

-continued

III-7

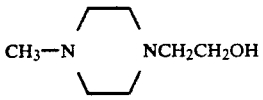

III-8

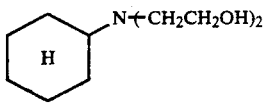

III-9

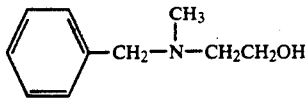

III-10 $(HOCH_2CH_2)_2NCH_2CH_2SO_3CH_3$

III-11 $HN(CH_2COOH)_2$

III-12 $HOOCCH_2CH_2CH(NH_2)COOH$

III-13 $H_2NCH_2CH_2SO_2NH_2$

III-14

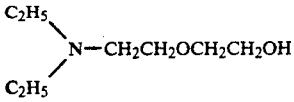

III-15 $H_2N-C(CH_2OH)_2$

III-16 $HOCH_2CH(NH_2)COOH$

III-17

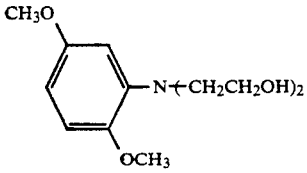

III-18

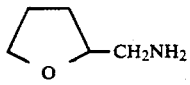

III-19

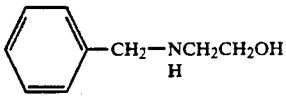

III-20

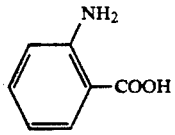

(IV)

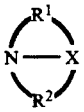

In the formula, X represents a trivalent atomic group needed for completing a condensed ring, and $R^1$ and $R^2$, which may be the same or different, each represents alkylene, arylene, alkenylene or aralkylene groups.

Particularly preferred compounds represented by formula (IV) are compounds represented by formulae (IV-a) and (IV-b):

(IV-a)

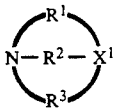

In the formula, $X^1$ represents

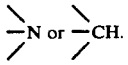

$R^1$ and $R^2$ have the same definition as in formula (IV), and $R^3$ represents the same group as $R^1$ and $R^2$, or is

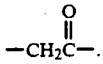

The case where $X^1$ is

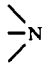

in general formula (IV-a) is preferred. The number of carbon atoms of each of $R^1$, $R^2$ and $R^3$ is preferably 6 or less, and still more preferably 3 or less, the case and most preferably 2.

$R^1$, $R^2$ and $R^3$ are preferably alkylene or arylene groups and are most preferably alkylene groups.

(IV-b)

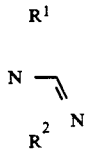

In the formula, $R^1$ and $R^2$ have the same definition as in formula (IV).

The number of carbon atoms of $R^1$ and $R^2$ is preferably 6 or less. $R^1$ and $R^2$ are preferably alkylene or arylene groups and are most preferably alkylene groups.

Among compounds represented by formulae (IV-a) and (IV-b), compounds represented by formula (IV-a) are particularly preferred.

Specific compounds represented by formulae (IV-a) and (IV-b) are as follows, but the present invention is not to be construed as being limited thereto.

IV-1

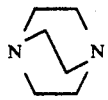

IV-2

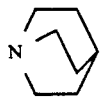

-continued

IV-3

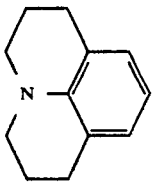

IV-4

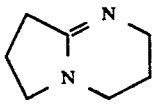

IV-5

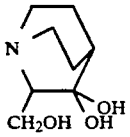

IV-6

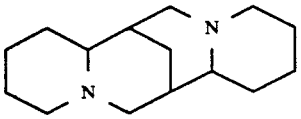

IV-7

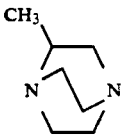

IV-7

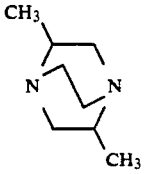

IV-9

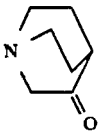

IV-10

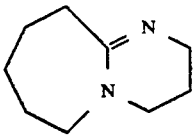

IV-11

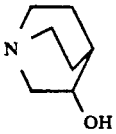

IV-12

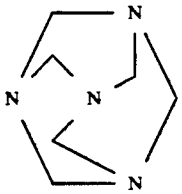

-continued

IV-13

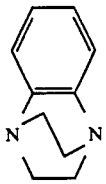

IV-14

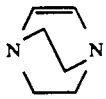

IV-15

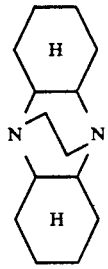

IV-16

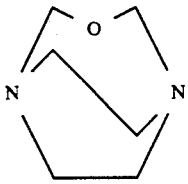

IV-17

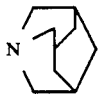

IV-18

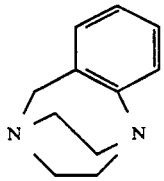

The above organic preservatives are available as commercial products, and they can be synthesized by the methods disclosed in Japanese Patent Applications 62-124038 and 62-24374.

A more detailed description of the color development solutions that are employed in the invention is now provided.

The color development solutions employed in the invention contain known primary aromatic amine developing agents. Preferred examples are p-phenylenediamines, typical examples of which follow, but the present invention is not to be construed as being limited thereto:

D-1 N,N-diethyl-p-phenylenediamine

D-2 4-[N-ethyl-N-(β-hydroxyethyl)amino]aniline

D-3 2-methyl-4-[[N-ethyl-N-(β-hydroxyethyl)amino]-aniline

D-4 4-amino-3-methyl-N-ethyl-N-(β-methanesulfonamidoethyl)aniline

These p-phenylenediamine derivatives may also be salts such as sulfates, hydrochlorides or p-toluenesulfonates. These primary aromatic amine developing agents are used in concentrations that are preferably about 1 g to 20 g and still more preferably about 0.5 to about 10 g per 1 liter of development solution.

The pH of the color development solution used in this invention is preferably 9 to 12 and still more preferably 9 to 11.0. Other known development solution components may be included in the color development solution.

Preferably, various buffers are employed in order to maintain the above-described pH. Examples of buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulf-2-hydroxybenzoate (potassium 5-sulfosalicylate).

The amount of such buffers added to the color development solution is preferably 0.1 mol/l or more, 0.1 to 0.4 mol/l being particularly preferred.

In addition, various chelating agents may be used in the color development solution for preventing the precipitation of calcium and magnesium or in order to improve the solution's stability.

Specific examples of chelating agents are as follows, but the present invention is not to be construed as being limited thereto; Nitrilotriacetic acid, diethylenetriaminepentaacetic acid, ethylenediaminetetraacetic acid, triethylenetetraminehexaacetic acid, N,N,N-trimethylenephosphonic acid, ethylenediamine-N,N,N'N'-tetramethylene-phosphinic acid, 1,3-diamino-2-propanoltetraacetic acid, transcyclohexanediamine-tetraacetic acid, nitrilotripropionic acid, 1,2-diaminopropanetetraacetic acid, hydroxyethyliminodiacetic acid, glycol ether diaminetetraacetic acid, hydroxyethylene-diaminetriacetic acid, ethylenediamine-orthohydroxyphenyl-acetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid, and 4-sulfosalicylic acid.

It is satisfactory if the amount of these chelating agents added is sufficient to sequester metal ions in the color development solution. For example, the amount is around 0.1 to 10 g per 1 liter.

If required, the thioether compounds noted in e.g., JP-B-37-16088, JP-B-37-5987, JP-B-38-7826, JP-B-44-12380 and JP-B-45-9019 and U.S. Pat. No. 3,813,247; the p-phenylenediamine compounds noted in JP-A-52-49829 and JP-A-50-15554; the quaternary ammonium salts noted in, e.g., JP-A-50-137726, JP-B-44-30074, JP-A-56-156826 and JP-A-52-43429; the p-aminophenols disclosed in U.S. Pat. Nos. 2,610,122 and 4,119,462; the amine compounds disclosed in, e.g., U.S. Pat. Nos. 2,494,903, 3,128,182, 4,230,796 and 3,253,919, JP-B-41-11431 and U.S. Pat. Nos. 2,482,546, 2,596,926 and 3,582,346; or the polyalkylene oxides noted in, e.g., JP-B-37-16088, JP-B-42-25201, U.S. Pat. No. 3,238,183, JP-B-41-11431, JP-B-42-23883 and U.S. Pat. No. 3,532,501, may be added as development accelerators and as well as these substances 1-phenyl-3-pyrazolidones, hydrazines, mesoionic compounds, ionic compounds and imidazoles may be added as required.

Preferably, the color development solution is substantially free of benzy alcohol. Substantially free as used herein means a content of not more than 2.0 ml per 1 liter of color development solution and preferably none at all. If the solution is essentially free of benzyl alcohol there is less fluctuation of photographic characteristics in continuous processing and better results are achieved.

In the invention, chloride ions and bromine ions may be added and any antifoggant may be added as required. Alkali metal compounds such as potassium iodide and organic antifoggants may be used as antifoggants. Benzotriazole, 6-nitrobenzimidazole, 5-nitroisoindazole, antifoggants may be used as antifoggants. 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine, adenine and similar nitrogen-containing heterocyclic compounds are representative examples of organic antifoggants.

Preferably, a brightening agent is included in the color development solution that is used in the invention. 4,4'-Diamino-2,2'-disulfostibene compounds are preferred as brightening agents. The amount added is 0 to 10 g/l and preferably 0.1 to 6 g/l.

The processing temperature of the color development solution of the invention is 20° to 50° C. and preferably 30° to 40° C. and the development processing time is 20 seconds to 5 minutes and preferably 30 seconds to 2 minutes.

Normally in color development the development solution is replenished.

The amount of replenishment depends on the photosensitive material being processed and generally it is on the order of 180 to 1000 ml per 1 square meter of photosensitive material. Replenishment is a means of keeping the color development solution composition constant so as to avoid changes in the characteristics of the development finish due to changes in composition concentrations in development processing in which a large amount of photosensitive material is continuously processed with an automatic development machine. From the point of view of cost and environmental pollution it is preferred to keep the amount of replenishment small, since replenishment inevitably gives rise to produce large amount of overflown solution. The preferred replenishment quantity is 20 to 150 ml per 1 $m^2$ of photosensitive material. Although there are some differences depending on the photosensitive material, a replenishment quantity of 20 ml per 1 $m^2$ of photosensitive material is approximately equal to the amount of processing solution carried out by the photosensitive material, and so overflow is essentially eliminated with this quantity. The present invention is useful in low-replenishment of this kind.

In the invention, desilvering is effected after color development. The desilvering stage generally consists of a bleaching step and a fixing step but the simultaneous performance of these steps is particularly preferred.

The bleaching solution or bleach-fix solution used in the invention may contain rehalogenation agents such as bromides (e.g., potassium bromide, sodium bromide, ammonium bromide), chlorides (e.g., potassium chloride, sodium chloride, ammonium chloride) or iodides (e.g., ammonium iodide). If required, one or more inorganic or organic acids which possess pH buffering capacity or alkali metal or ammonium salts thereof such as boric acid, borax, sodium metaborate, acetic acid, sodium acetate, sodium carbonate, potassium carbonate, phosphorous acid, phosphoric acid, sodium phosphate, citric acid, sodium citrate or tartaric acid, and corrosion preventives such as ammonium nitrate and guanidine may be added.

The fixer used in the bleach-fix or fixing solution in the invention may be a known fixer, i.e., a thiosulfate such as sodium thiosulfate or ammonium thiosulfate; a thiocyanate such as sodium thiocyanate or ammonium thiocyanate; a thioether compound such as ethylenebisthioglycolic acid or 3,6-dithia-1,8-octanediol or a thiourea or similar water-soluble silver halide solvent, used alone or as a mixture of two or more substances. It is also possible to use, e.g., the special bleach-fixing solution disclosed in JP-A-55-155354 consisting of a fixer and a large amount of a halide such as potassium iodide. In the invention, use of a thiosulfate, especially ammonium thiosulfate, is preferred. The amount of fixer per 1 liter is preferably 0.3 to 2 moles and more preferably is in the range 0.5 to 1.0 moles.

The pH of the bleach-fix solution or bleaching solution in the invention is preferably 3 to 10 and more preferably 5 to 9. A pH lower than this improves desilvering but promotes deterioration of the solution and achromatization of cyan dyes. If the pH is higher than this region desilvering is slowed down and stains are liable to be produced.

If required, substances such as hydrochloric acid, sulfuric acid, nitric acid, acetic acid, bicarbonates, ammonia, caustic potash, caustic soda, sodium carbonate and potassium carbonate may be added in order to regulate the pH.

The bleach-fix solution may also contain various brightening agents, antifoaming agents, surfactants, or organic solvents such as polyvinylpyrrolidone and methanol.

The bleach-fix solution or fixing solution in the invention contains a preservative in the form of a sulfite (e.g., sodium sulfite, potassium sulfite, ammonium sulfite), a bisulfite (e.g., ammonium bisulfite, sodium bisulfite, potassium bisulfite), a metabisulfite (e.g., potassium metabisulfite, sodium metabisulfite, ammonium metabisulfite) or similar sulfite-ion releasing compound. Converted to sulfite ions, the amount of such compounds included is preferably 0.02 to 0.50 mol/l and more preferably 0.04 to 0.40 mol/l.

It is normal practice to add sulfites as preservatives, but it is also possible to add ascorbic acid, carbonyl bisulfite adducts, sulfinic acids or carbonyl compounds.

Substances such as buffers, brightening agents, chelating agents and antifungal agents may be used if required.

Generally, the silver halide color photographic photosensitive material of the invention is subjected to a washing and/or stabilization stage after fixing, bleach-fixing and similar desilvering treatment.

The amount of washing water in the washing stage can be set in accordance with a wide range of conditions such as the characteristics of the photosensitive material (which, depend on the material used for the couplers), the purpose of the material, the washing water temperature, the number of washing tanks (the number of stages) and whether a counterflow or direct flow replenishment system is used. The relation between the amount of water and the number of washing stages in a multistage counterflow system can be determined by the method described in the *Journal of the Society of Motion Picture and Television Engineers*, Vol. 64, p. 248–253 (May 1955).

The multistage counterflow system there described makes it possible to greatly reduce the amount of washing water, but creates problems such as the proliferation of bacteria and adhesion to the photosensitive material of suspended matter that forms because of the increased dwell-time of water in the tanks. A very effective measure that may be employed to resolve such problems in processing of the color photosensitive material of the invention is to use the method disclosed in JP-A-61-131632 for reducing calcium and magnesium. Alternatively, isothiazolone compounds or thiabenzazoles disclosed in JP-A-57-8542, sodium chloroisocyanurate or similar chlorine-based bactericides, benzotriazoles or the bactericides described by Dr. Horiguchi in *Sakkin-Bobaizai no Kaqaku* (*Chemistry of Antibacterial-Antifungal Agents*), *Biseibutsu no Mekkin, Sakkin, Bobai Gijutsu* (*Microorganism Sterilization, Bactericidal Antifungal Technology*) edited by the Eisei Gijutsukai (Hygiene Technology Institute) or *Bokin-Bobai Jiten* (*Dictionary of Bacteria - Fungus Prevention*) edited by the Nihon Bokin Bobai Gakkai (Japan Antibacterial Antifungal Institute) can be used.

The pH of the washing water during processing of the photosensitive material of the invention is 4 to 9 and preferably 5 to 8. The washing water temperature and the washing time can be widely varied depending on the photosensitive material's characteristics and intended use, but generally values in the range of 20 seconds to 5 minutes at 25° to 40° C., are selected.

The photosensitive material of the invention can also be processed directly by a stabilization solution without being washed. Any of the known methods disclosed in, e.g., JP-A-57-8543, JP-A-58-14834, JP-A-59-184343, JP-A-60-220345, JP-A-60-238832, JP-A-60-239784, JP-A-60-239749, JP-A-61-4054 and JP-A-61-118749 may be used for this form of stabilization treatment. In particular, a stabilization bath containing compounds such as 1-hydroxyethylidene-1,1-diphosphonic acid, 5-chloro-2-methyl-4-isothiazolin-3-one, bismuth compounds and ammonium compounds, is preferably used.

In some cases, stabilization treatment is effected after washing treatment, by using a stabilization bath which contains formalin and a surfactant, as the last bath for the photographic color photosensitive material.

The processing stages time in the invention is defined as the time from when the photosensitive material comes into contact with the color development solution unit it exists from the final bath (usually a washing or stabilization bath) and the advantages of the invention are particularly marked when this rapid treating process stages time is 4 minutes 30 seconds or less or better 4 minutes or less.

The rapid treating process according to the present invention generally comprises following steps:

(A) Developing - Bleaching - Fixing - Washing - (Stabilizing)

(B) Developing - Bleach-fixing - Washing - (Stabilizing)

(C) Developing - Bleaching - Bleach-fixing - Washing - (Stabilizing)

In the above steps Stabilizing step is optional.

The silver halide color photographic photosensitive material of the invention is now described in greater detail.

The silver halide emulsion of the invention is composed substantially of silver chloride. What is meant here by 'substantially' is that the silver chloride content relative to the total amount of silver halide is 80 mol % or more and preferably 95 mol % or more and still more preferably 98 mol % or more. From the point of view of rapidity, the higher the silver chloride content the better. A small amount of silver bromide or silver iodide may be included in the high silver chloride of the invention. This offers many advantages for photosensitivity, by increasing the amount of light absorbed, strengthening the adsorption of spectrally sensitized dyes or weakening the effects of desensitization due to spectrally sensitized dyes.

The silver halide included in the silver halide emulsion of the photographic photosensitive material that is used in the invention may have different phases in internal and outer layers or may have a multiphase structure in a bonded arrangement, or the grains may have a uniform phase throughout. The grain may be a mixture of these types.

The silver halide grains in the photographic emulsion may be cubic, octahedral, tetradecahedral or similar regular crystals, or may have a spheroidal, tabular-shaped or similar irregular crystal shapes or crystal defects, such as twin crystal planes, or they may have combinations of these forms.

The silver halide grains may be microscopic grains with a grain diameter of about 0.2 microns or less or large-size grains with a projected area diameter of up to about 10 microns, and the emulsion may be a polydisperse emulsion or a monodisperse emulsion.

A silver halide photographic emulsion used in the invention can be prepared by methods described in *Research Disclosure* (RD) No. 17643 (December 1978), pages 22–23, I. Emulsion Preparation and Types.

Monodisperse emulsions such as those disclosed in e.g., U.S. Pat. Nos. 3,574,628 and 3,655,394 and U.K. Patent 1,413,748 are suitable.

It is also possible to use tabular grains with an aspect ratio of about 5 or more in the invention. Tabular grains can be simply prepared by procedures such as described by Gutoff, *Photographic Science and Engineering*, Vol. 14, pages 248–257 (1970), U.S. Pat. Nos. 4,434,226, 4,414,310, 4,433,048 and 4,439,520 and U.K. Patent 2,112,157.

Even if the grains have a uniform crystal structure their interior portions and exterior portions may have different halogen compositions and the grains may also have a lamellar structure. Further, silver halides with different compositions may be bonded by epitaxial bonding and they may be bonded with compounds other than silver halides, e.g., silver thiocyanate or lead oxide.

A mixture of grains with a variety of crystal shapes, may also be used.

A variety of polyvalent metal ion impurities may be introduced into the silver halide emulsion used in the invention during the emulsion grain formation stage or physical ripening stage. Examples of compounds that can be used include salts of cadmium, zinc, copper and thallium, and salts or complex salts of the group VIII elements iron, ruthenium, rhodium, palladium, osmium, iridium and platinum. These group VIII elements are preferred. The amounts of such compounds added extends over a wide range depending on purpose and is suitably $10^{-9}$ to $10^{-2}$ moles relative to the silver halide.

Silver halide emulsions are generally used after physical ripening, chemical ripening and spectral sensitization. Additives that are used in these stages are described in *Research Disclosure* No. 17643 and No. 18716, listed in the table below.

The two issues of *Research Disclosure* noted above also describe known photographic additives that can be used in the invention, as described in the following table.

| | Type of Additives | RD 17643 | RD 18716 |
|---|---|---|---|
| 1. | Chemical Sensitizers | Page 23 | Page 648, right column |
| 2. | Speed Enhancers | | Page 648, right column |
| 3. | Spectral Sensitizers Strong Color Sensitizers | Pages 23 to 24 | Page 648, right column to page 649, right column |
| 4. | Brightening Agents | Page 24 | |
| 5. | Antifoggants and Stabilizers | Pages 24 to 25 | Page 649, right column |
| 6. | Light-Absorbers, Filter Dyes, UV-Ray Absorbers | Pages 25 to 26 | Page 649, right column to page 650, left column |
| 7. | Stain preventives | Page 25, right column | Page 650, left column to right column |
| 8. | Dye Image Stabilizers | Page 25 | |
| 9. | Hardeners | Page 26 | Page 651, left column |
| 10. | Binders | Page 26 | Page 651, left column |
| 11. | Plasticizers, Lubricants | Page 27 | Page 650, right column |
| 12. | Coating Assistants, Surfactants | Pages 26 to 27 | Page 650, right column |
| 13. | Antistatic Agents | Page 27 | Page 650, right column |

A variety of color couplers can be used in the invention. Specific examples of these are described in the patents cited in *Research Disclosure* (RD) No. 17643 VII-C to G.

The couplers disclosed in U.S. Pat. Nos. 3,933,501, 4,022,620, 4,326,024 and 4,401,752, JP-B-58-10739 and U.K. Patents 1,425,020 and 1,476,760 are preferred as yellow couplers.

5-Pyrazolone and pyrazoloazole compounds are preferred as magenta couplers, the materials disclosed in U.S. Pat. Nos. 4,310,619 and 4,351,897, European Patent 73,636, U.S. Pat. Nos. 3,061,432, 3,725,067, *Research Disclosure* No. 24220 (June 1984), JP-A-60-33552, *Research Disclosure* No. 24230 (June 1984), JP-A-60-43659 and U.S. Pat. Nos. 4,500,630, 4,540,654 and 4,556,630 and WO (PCT) 88/04795 being particularly preferred.

Phenolic and naphtholic couplers can be used as cyan couplers, the materials as disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) 3,329,729, European Patent 121,365A, U.S. Pat. Nos. 3,446,622, 4,333,999, 4,451,559, 4,427,767, 4,690,889, 4,254,212 and 4,296,199, European Patent 161,626 and JP-A-61-42658 being preferred.

The colored couplers disclosed in *Research Disclosure* No. 17643 page VII-G, U.S. Pat. No. 4,163,670, JP-B-57-39413, U.S. Pat. Nos. 4,004,929 and 4,138,258 and U.K. Patent 1,146,368 are preferred for correcting unwanted coupling dye absorption.

The materials disclosed in U.S. Pat. No. 4,366,237, U.K. Patent 2,125,570, European Patent 96,570 and West German Patent Application (OLS) 3,234,533 are preferred couplers providing coupling dyes with suitable diffusion characteristics.

Typical examples of polymerized dye-forming couplers are disclosed in U.S. Pat. Nos. 3,451,820, 4,080,211 and 4,367,282 and U.K. Patent 2,102,173.

Couplers which release photographically useful residual groups during coupling also may be suitably employed in the invention. The materials disclosed in the patents noted in RD17643 page VII-F, JP-A-57-151944, JP-A-57-154234 and JP-A-60-184248 and U.S. Pat. No. 4,248,962 are preferred DIR couplers which release development inhibition agents.

The materials disclosed in U.K. Patents 2,097,140 and 2,131,188, JP-A-59-157638 and JP-A-59-70840 are preferred couplers which release nucleating agents in image form or development acceleration agents at the time of development.

Other couplers which may be used in the photosensitive material of the invention include the competing couplers disclosed in U.S. Pat. No. 4,130,427, the polyequivalent couplers disclosed in U.S. Pat. Nos. 4,283,472, 4,338,393 and 4,310,618, the DIR redox compound releasing couplers disclosed in, e.g., JP-A-60-85950 and the couplers disclosed in European Patent 73,302A which release dyes that recolor after elimination.

The couplers used in the invention may be introduced into the photosensitive material by a variety of known dispersion methods.

Examples of high boiling point solvents that can be used in an oil-in-water droplet dispersion method are disclosed in U.S. Pat. No. 2,322,027.

Specific examples of latex dispersion methods and latexes for impregnation are disclosed in U.S. Pat. No. 4,199,363 and West German Patent Applications (OLS) 2,541,274 and 2,541,230.

Preferably the compounds noted below are used together with the couplers in the invention, in particular in combination with pyrazoloazole couplers.

Simultaneous or independent use of a compound (F), show below, which bonds chemically with an aromatic amine developing agent remaining after color development to form a compound that is chemically inert and essentially colorless and/or a compound (G) which bonds chemically with the oxidation products of aromatic amine color developing agent oxides remaining after color development to form a compound that is chemically inert and essentially colorless is desirable. It prevents stains and other side effects caused by coupler dye formation due to a reaction between couplers and color developing agents or oxidation products thereof remaining in the film in post-processing storage.

Compound (F) is preferably a compound whose secondary reaction rate constant k2 in reaction with p-anisidine (in 80° C. trioctyl phosphate) is in the range 1.0 l/mol.sec to $1\times10^{-5}$ l/mol.sec. The secondary reaction rate constant can be determined by the method described in JP-A-63-158545.

If k2 is above this range, the compound itself becomes unstable and may be decomposed through reaction with gelatin or water. On the other hand, if k2 is below this range, its reaction with residual aromatic amine developing agents is slow and consequently it is not possible to prevent side effects from residual aromatic amine developing agents.

Preferred examples of this compound (F) are represented by formulas (FI) and (FII).

$$R_1-(A)_n-X \qquad \text{(FI)}$$

-continued $$R_2-\underset{\underset{B}{|}}{C}-Y \qquad \text{(FII)}$$

In the formulae, $R_1$ and $R_2$, which may be the same or different, each represents aliphatic, aromatic or heterocyclic groups. n represents 1 or 0. A represents a group which reacts with an aromatic amine developing agent to form a chemical bond, and X represents a group which is eliminated through reaction with an aromatic amine developing agent. B represents hydrogen or an aliphatic, aromatic, heterocyclic, acyl or sulfonyl group; and Y represents a group which accelerates addition of an aromatic amine developing agent to a compound of general formula (FII). A cyclic structure may be formed by bonding of $R_1$ with X and Y with $R_2$ or B.

Typical modes of chemical bonding with the residual aromatic amine developing agent are a substitution reaction and an addition reaction.

The compounds disclosed in, e.g., JP-A-63-15845, JP-A-62-283338 and Japanese Patent Applications 62-158342 and 63-18439 are suitable as specific examples of compounds representable by formulae (FI) and (FII).

Preferred examples of compound (G) which bonds chemically with the oxidation products of residual aromatic amine developing agent to form a chemically inert, colorless compound after color development processing are represented by formula (GI):

$$R-Z \qquad \text{(GI)}$$

In the formula, R represents an aliphatic group, aromatic residue or heterocyclic group. Z represents a nucleophilic group or a group which is decomposed in the photosensitive material after development and releases a nucleophilic group. The compound represented by formula (GI) is preferably one in which Z is a group having a Pearson's nucleophilicity $^{n}CH_3I$ value (R. G. Pearson et al., *J. Am. Chem. Soc.*, 90, 319 (1968)) of 5 or more, or is a group derived from such a group.

The compounds disclosed in, e.g., European Patent Application (OPI) 255722, JP-A-62-143048, JP-A-62-229145 and Japanese Patent Applications 63-18439, 63-136724, 62-214681 and 62-158342 are suitable as specific examples of compounds represented by formula (GI).

Suitable combinations of compound (G) and compound (F) are described in Japanese Patent Application 63-18439.

Supports suitable for use in the invention are described in, RD No. 17643, page 28 and No. 18716, page 647 right-hand column to page 648 left-hand column.

The photosensitive material to which the invention is applied may be any color photographic photosensitive material such as, e.g., a color negative film, color reversal film (internal type or external type), color paper, color positive film, color reversal paper, color diffusion transfer process material and direct positive color photosensitive material, but its use for color negative film, color reversal film and color transfer paper is particularly preferred.

The present invention is now illustrated in greater detail with reference to the following specific examples, but the present invention is not to be construed as being limited thereto. Unless otherwise indicated, all part, percents and ratios are by weight.

EXAMPLE 1

A multilayer color printing paper with the layer structure described below was prepared on a paper support laminated on both sides with polyethylene. The coating solutions were prepared as follows.

Preparation of 1st Layer Coating Solution 60.0 g of a yellow coupler (E×Y) and 28.0 g of a fading preventive (Cpd-1) were dissolved by addition of 150 cc of ethyl acetate, 1.0 cc of a solvent (Solv-3) and 3.0 cc of another solvent (Solv-4). To this solution was added 450 cc of a 10% gelatin aqueous solution containing sodium dodecylbenzenesulfonate and then dispersion was effected in an ultrasonic homogenizer and the resulting dispersion was mixed with and dissolved in 420 g of a silver chlorobromide emulsion (silver bromide 0.7 mol %) containing the blue sensitization dye described below, providing the 1st layer coating solution. The coating solution of the 2nd to 7th layers were prepared in the same manner. 1,2-Bis(vinylsulfonyl)ethane was used as a gelatin hardener for each layer.

The following substances were used as the spectral sensitization dyes for the various layers.

Blue-sensitive Emulsion Layer

Anhydro-5-5'-chloro-3,3'-disulfoethylthiacyanine hydroxide

Green-sensitive Emulsion Layer

Anhydro-9-ethyl-5,5'-diphenyl-3,3'-disulfoethyloxacarbocyanine hydroxide

Red-sensitive Emulsion Layer 3,3'-diethyl-5-methoxy-9,9'-(2,2'-dimethyl-1,3-propano)thiadicarbocyanine iodide The following material was used as a stabilizer for each layer.

| | | |
|---|---|---|
| 1-(2-acetoaminophenyl)-5-mercaptotetrazole | 7 | Mixture (molar ratio) |
| 1-phenyl-5-mercaptotetrazole | 2 | |
| 1-(p-methoxyphenyl)-5-mercaptotetrazole | 1 | |

The following substances were used as antiirradiation dyes.

[3-carboxy-5-hydroxy-4-(3-(3-carboxy-5-oxo-1-(2,5-disulfonatophenyl)-2-pyrazolin-1-hydrazolyl]benzene-2,5-disulfonate, disodium salt N,N'-(4,8-dihydroxy-9,10-dioxo-3,7-disulfonatoanthracene-1,5-diyl)bis(aminomethanesulfonat), tetrasodium salt 3-cyano-5-hydroxy-4-(3-(3-cyano-5-oxo-1-(4-sulfonatophenyl)-2-pyrazoline-4-ylidene)-1-pentanyl)-1-pyralolyl]benzene-4-sulfonate, sodium salt

Layer Structure

The compositions of the various layers are described below. The figures indicate coating quantities (g/m$^2$). Coating quantities calculated as silver are given for silver halide emulsions.

Support

Paper support - laminated on both sides with polyethylene

| | |
|---|---|
| **1st Layer: Blue-sensitive Layer** | |
| Silver halide emulsion (AgBr: 0.7 mol %, cubic, average grain size 0.9 μm) | 0.27 |
| Gelatin | 1.80 |
| Yellow coupler (ExY) | 0.60 |
| Fading preventive (Cpd-1) | 0.28 |
| Solvent (Solv-3) | 0.01 |
| Solvent (Solv-4) | 0.03 |
| **2nd Layer: Color-mixing Prevention Layer** | |
| Gelatin | 0.80 |
| Color-mixing preventive (Cpd-2) | 0.055 |
| Solvent (Solv-1) | 0.03 |
| Solvent (Solv-2) | 0.015 |
| **3rd Layer: Green-sensitive Layer** | |
| Silver halide emulsion (AgBr: 0.7 mol %, cubic, average grain size 0.45 μm) | 0.28 |
| Gelatin | 1.40 |
| Magenta coupler (ExM) | 0.67 |
| Fading preventive (Cpd-3) | 0.23 |
| Fading preventive (Cpd-4) | 0.11 |
| Solvent (Solv-1) | 0.20 |
| Solvent (Solv-2) | 0.02 |
| **4th Layer: Color-mixing Prevention Layer** | |
| Gelatin | 1.70 |
| Color-mixing preventive (Cpd-2) | 0.065 |
| Ultraviolet ray absorber (UV-1) | 0.45 |
| Ultraviolet ray absorber (UV-2) | 0.23 |
| Solvent (Solv-1) | 0.05 |
| Solvent (Solv-2) | 0.05 |
| **5th Layer: Red-sensitive Layer** | |
| Silver halide emulsion (AgBr: 0.7 mol %, cubic, average grain size 0.5 μm) | 0.19 |
| Gelatin | 1.80 |
| Cyan coupler (ExC-1) | 0.26 |
| Cyan coupler (ExC-2) | 0.12 |
| Fading preventive (Cpd-1) | 0.20 |
| Solvent (Solv-1) | 0.16 |
| Solvent (Solv-2) | 0.09 |
| **6th Layer: Ultraviolet Absorption Layer** | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| **7th Layer: Protective Layer** | |
| Gelatin | 1.07 |

The compounds used were as follows:

(E×Y) Yellow coupler
α-pivaroyl-α-(3-benzyl-1-hydantoinyl)-2-chloro-5-[β-dodecylsulfonyl)-butylamido]acetoanilide (E×M) Magenta coupler
1-(2,4,6-trichlorophenyl-3[2-chloro-5-(3-octadecenylsuccinimido)anilino]-5-pyrazolone (E×C-1) Cyan coupler
2-Pentafluorobenzamido-4-chloro-5-[2-(2,4-di-tert-amylphenoxy)-3-methylbutylamido]phenol (E×C-2) Cyan coupler
2,4-dichloro-3-methyl-6-[α-2,4-di-tert-amylphenoxy)-butylamido]phenol (Cpd-1) Color-fading preventive
2,5-di-tert-amylphenyl-3,5-di-tert-butylhydroxy benzoate (Cpd-2) Color-mixing preventive
2,5-di-tert-octylhydroquinone (Cpd-3) Color-fading preventive
1,4-di-tert-amyl-2,5-dioctyloxybenzene (Cpd-4) Color-fading preventive
2,2'-methylenebis(4-methyl-6-tert-butylphenol)

(Cpd-5)
p-(p-toluenesulfonamido)phenyldodecane
(Solv-3) Solvent
Di(i-nonyl)phthalate
(Solv-4) Solvent
N,N-diethylcarbonamidomethoxy-2,4-di-t-amylbenzene
(UV-1) Ultraviolet absorber
2-(2-hydroxy-3,5-di-tert-amylphenyl)benzotriazole
(UV-2) Ultraviolet ray absorber
2-(2-hydroxy-3,5-di-tert-butylphenyl)benzotriazole
(Solv-1) Solvent
Di-(2-ethylhexyl)phthalate
(Solv-2) Solvent
Dibutyl phthalate The sample material prepared in the manner indicated above was designated as A. Samples B to E were prepared by making the changes noted in Table 1 to the emulsion silver halide compositions.

TABLE 1

| Sample | Emulsion Silver Halide Composition (Cl content mol %) BL | GL | RL |
|---|---|---|---|
| A | 99.3 | 99.3 | 98 |
| B | 95 | 95 | 95 |
| C | 80 | 80 | 80 |
| D | 70 | 70 | 70 |
| E | 50 | 50 | 50 |

The following tests were conducted in order to investigate the photographic characteristics of these coating samples.

First, the coating samples were subjected to graduated exposure for sensitometry using a sensitometer (FWH model manufactured by Fuji Photo Film KK, light source color temperature 3200° K.). This was effected at exposures of 250 CMS for 1/10 second The coating samples were processed in an automatic development machine by the processing stages and processing solutions noted below. The composition of the color development solution was varied in the manner indicated in Table 2.

| Processing Stage | Temperature | Time |
|---|---|---|
| Color development | 38° C. | 45 seconds |
| Bleach-fix | 30-36° C. | 45 seconds |
| Rinse (1) | 30-37° C. | 30 seconds |
| Rinse (2) | 30-37° C. | 30 seconds |
| Rinse (3) | 30-37° C. | 30 seconds |
| Drying | 70-80° C. | 60 seconds |

The compositions of the various processing solutions were as follows.

| | |
|---|---|
| Color Development Solution | |
| Water | 800 ml |
| Ethylenediamine-N,N,N,N,-tetramethylenephosphonic acid | 3.0 g |
| Organic preservative A (I-1) | 0.03 mol |
| Sodium chloride | See Table 2 |
| Potassium bromide | See Table 2 |
| Potassium carbonate | 25 g |
| N-ethyl-N-(β-methanesulfonamidoethyl)-3-methyl-4-aminoaniline sulfite | 5.0 g |
| Triethanolamine | 10.0 g |
| Brightening agent (4,4'-diaminostilbene based) | 2.0 g |
| Sodium sulfite | 0.1 g |
| Water added | 1000 ml |
| pH (25° C.) | 10.05 |
| Bleach-fix Solution | |
| Water | 400 ml |
| Ammonium thiosulfate (70%) | 100 ml |
| Sodium sulfite | 17 g |
| Ferric(III) ammonium ethylenediaminetetraacetate | 55 g |
| Disodium ethylenediaminetetraacetate | 5 g |
| Ammonium bromide | 40 g |
| Glacial acetic acid | 9 g |
| Water added | 1000 ml |
| pH (25° C.) | 5.40 |

Rinse Solution

Ion exchange water (both calcium and magnesium each not more than 3 ppm)

The blue (B), green (G) and red (R) maximum densities (Dmax) achieved in the sensitometry described above were measured by means of a Macbeth densitometer. The results are shown in Table 2.

The coating samples were also subjected to exposure to uniform grey light using a sensitometer (FWH model manufactured by Fuji Photo Film KK, light source color temperature 3200° K.) and processed in the same way as described above, and assessment of sensitization streaks was made. The assessment standards were in 4 stages, as follows.

| Sensitization Streak Assessment | Number of Sensitization Streaks in 100 $cm^2$ (10 cm × 10 cm) of Sample |
|---|---|
| ○ | 0 |
| Δ | 1-2 |
| x | 3-5 |
| xx | 6 or more |

TABLE 2

| Processing Example | 1 | 2 | 3 | 4 | 5 | 6 | 7 | 8 |
|---|---|---|---|---|---|---|---|---|
| Coating Sample | A | A | A | A | B | C | A | A |
| Development Solution Chloride Ion Concentration (mol/l) | $3.5 \times 10^{-2}$ | $4.0 \times 10^{-2}$ | $1.0 \times 10^{-1}$ | $1.5 \times 10^{-1}$ | $1.0 \times 10^{-1}$ | $1.0 \times 10^{-1}$ | 0 | $1.0 \times 10^{-1}$ |
| Development Solution Bromide Ion Concentration (mol/l) | $3.0 \times 10^{-5}$ | $5.0 \times 10^{-5}$ | $5.0 \times 10^{-4}$ | $1.0 \times 10^{-3}$ | $5.0 \times 10^{-4}$ | $5.0 \times 10^{-4}$ | $1.0 \times 10^{-6}$ | 0 |
| Remarks | Invention | Invention | Invention | Invention | Invention | Invention | Comparison Example | Comparison Example |
| BL (Dmax) | 2.40 | 2.41 | 2.40 | 2.38 | 2.37 | 2.35 | 2.40 | 2.41 |
| GL (Dmax) | 2.51 | 2.51 | 2.50 | 2.50 | 2.48 | 2.47 | 2.50 | 2.49 |
| RL (Dmax) | 2.98 | 2.97 | 2.98 | 2.97 | 2.96 | 2.95 | 2.97 | 2.98 |
| Sensitization | ○ | ○ | ○ | ○ | ○ | ○ | xx | xx |

TABLE 2-continued

| Streaks | | | | | | | | | |
|---|---|---|---|---|---|---|---|---|---|
| Processing Example | 9 | 10 | 11 | 12 | 13 | 14 | 15 | 16 | 17 |
| Coating Sample | A | B | C | D | E | D | D | D | D |
| Development Solution Chloride Ion Concentration (mol/l) | $3.0 \times 10^{-1}$ | $3.0 \times 10^{-1}$ | 0 | $1.0 \times 10^{-1}$ | $1.0 \times 10^{-1}$ | 0 | $3.5 \times 10^{-2}$ | $1.5 \times 10^{-1}$ | $3.0 \times 10^{-1}$ |
| Development Solution Bromide Ion Concentration (mol/l) | $5.0 \times 10^{-3}$ | $1.0 \times 10^{-6}$ | 0 | $1.0 \times 10^{-3}$ | $1.0 \times 10^{-3}$ | 0 | $3.0 \times 10^{-5}$ | $1.0 \times 10^{-3}$ | $5.9 \times 10^{-3}$ |
| Remarks | Comparison Example | Comparison Example | Comparison Example | Comparison Example | Comparison Example | Comparison Example | Comparison Example | Comparison Example | Comparison Example |
| BL (Dmax) | 1.90 | 2.01 | 2.38 | 1.69 | 1.38 | 1.72 | 1.70 | 1.69 | 1.63 |
| GL (Dmax) | 2.23 | 2.29 | 2.49 | 2.01 | 1.98 | 2.08 | 2.05 | 2.00 | 2.00 |
| RL (Dmax) | 2.76 | 2.80 | 2.96 | 2.58 | 2.39 | 2.62 | 2.60 | 2.56 | 2.50 |
| Sensitization Streaks | ○ | xx | xx | Δ | Δ | Δ | Δ | Δ | Δ |

It is apparent from Table 2 that in processing examples 1 to 6 in which the photosensitive materials A to C of the invention were processed with development solutions of the invention, the maximum density was high and occurrence of sensitization streaks was prevented.

In processing example 9, sensitization streaks were prevented but the maximum density was low and rapid development was not achieved. In processing examples 7, 8, 10 and 11, the maximum density was high but sensitization streaks occurred.

With processing examples 12 to 17, there was less occurrence of sensitization streaks but the maximum density was low and again rapid development processing was not achieved. As seen in examples 12 and 14 to 17, when use was made of a photosensitive material whose silver chloride content is less than 80 mol % there was hardly any change in occurrence of pressure sensitization streaks or the maximum density, regardless of whether the chlorine ion and bromine ion concentration were within the ranges of the invention or not. As seen in processing examples 1 to 11, when a high silver chloride photosensitive material was used the characteristic maximum density and prevention of sensitization streaks were achieved only when the chlorine ion and bromine ion concentrations were within the ranges of the invention.

EXAMPLE 2

A multilayer color printing paper with the layer structure described below was prepared on a paper support laminated on both sides with polyethylene. The coating solutions were prepared as follows.

Preparation of 1st layer coating solution 19.1 g of a yellow coupler (E×Y), 4.4 g of a color image stabilizer (Cpd-1) and 0.7 g of another color image stabilizer (Cpd-7) were dissolved by addition of 27.2 cc of ethyl acetate and 8.2 g of a solvent (Solv-3). This solution was emulsified and dispersed in 185 cc of a 10% gelatin aqueous solution containing 8 cc of sodium dodecylbenzenesulfonate. Meanwhile, an emulsion was produced by adding to a silver chlorobromide emulsion (average cubic grain size 0.85 μm, cubic grains with a grain size distribution variation coefficient of 0.07 and containing locally present 1.0 mol % silver bromide in some parts on grain surfaces) the two types of blue-sensitization dyes described below in an amount that was $2.0 \times 10^{-4}$ moles per 1 mole of silver in each case, and effecting sulfur sensitization. This emulsion and the emulsified dispersion described above were mixed and dissolved to give a 1st coating solution with the composition noted below. The coating solutions of the 2nd to 7th layers were prepared in the same manner. 1-oxy-3,5-dichloro-s-triazine sodium salt was used as a gelatin hardener for each layer.

The following substances were used as spectral sensitization dyes in the various layers.

Blue-sensitive emulsion layer

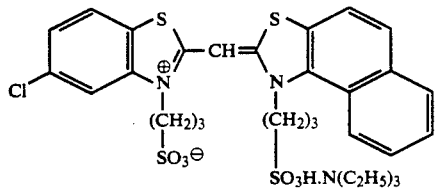

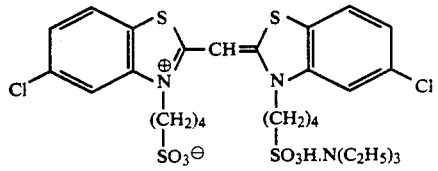

($2.0 \times 10^{-4}$ moles of each of the above 2 types per 1 mole of silver halide)

-continued

Green-sensitive emulsion layer

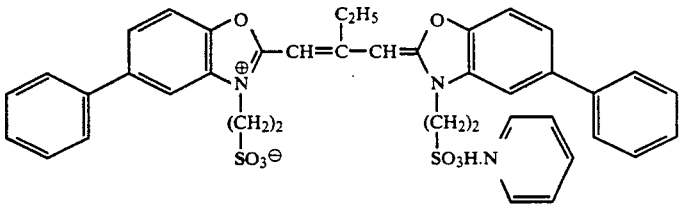

($4.0 \times 10^{-4}$ moles per 1 mole of silver halide)

and

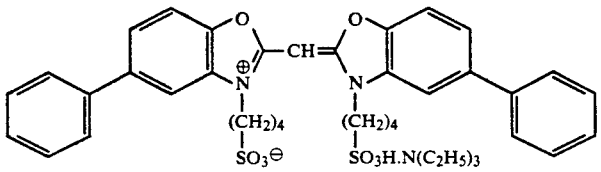

($7.0 \times 10^{-5}$ moles per 1 mole of silver halide)

Red-sensitive emulsion layer

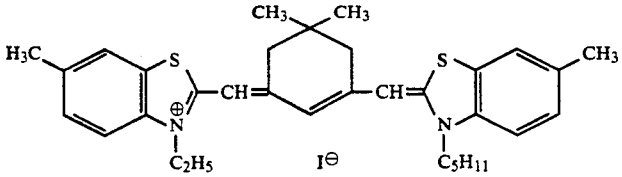

($0.9 \times 10^{-4}$ moles per 1 mole of silver halide)

The following compound was added to the red-sensitive emulsion layer in an amount that was $2.6 \times 10^{-3}$ moles per 1 mole of silver halide.

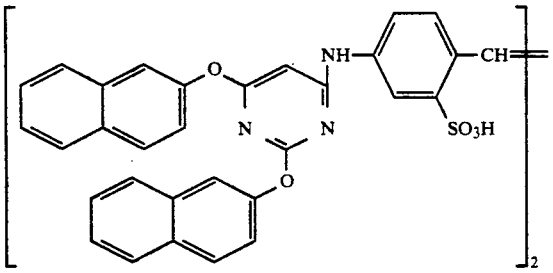

Also, to the blue-sensitive emulsion layer, green-sensitive emulsion layer and red-sensitive emulsion layer were added 1-(5-methylureidophenyl)-5-mercaptotetrazole in amounts that were respectively $8.5 \times 10^{-5}$ moles, $7.7 \times 10^{4}$ moles and $2.5 \times 10^{-5}$ moles per 1 mole of silver halide.

The following dyes were added to the emulsion layers to prevent irradiation.

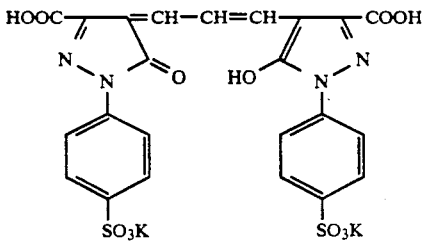

and

-continued

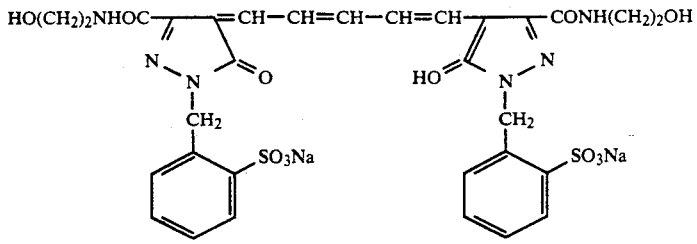

Layer Structure

The figures indicate coating quantities (g/m$^2$). Coating quantities calculated as silver are given for silver halide emulsions.

Support

Polyethylene-laminated paper.

(The polyethylene on the 1st layer side contained a white pigment ($TiO_2$) and a blue dye (ultramarine).)

| | |
|---|---|
| 1st Layer: Blue-sensitive Layer | |
| The silver chlorobromide emulsion described above | 0.30 |
| Gelatin | 1.86 |
| Yellow coupler (ExY) | 0.82 |
| Color image stabilizer (Cpd-1) | 0.19 |
| Color image stabilizer (Cpd-7) | 0.03 |
| Solvent (Solv-3) | 0.35 |
| 2nd Layer: Color-mixing Prevention Layer | |
| Gelatin | 0.99 |
| Color-mixing preventive (Cpd-5) | 0.08 |
| Solvent (Solv-1) | 0.16 |
| Solvent (Solv-4) | 0.08 |
| 3rd Layer: Green-sensitive Layer | |
| Silver chlorobromide emulsion (cubic grain size 0.40 μm, grain size distribution variation coefficient 0.09, includes locally present 1 mol % silver bromide in some parts on grain surfaces) | 0.20 |
| Gelatin | 1.24 |
| Magenta coupler (ExM) | 0.29 |

-continued

| | |
|---|---|
| Color image stabilizer (Cpd-3) | 0.09 |
| Color image stabilizer (Cpd-4) | 0.06 |
| Solvent (Solv-2) | 0.32 |
| Solvent (Solv-7) | 0.16 |
| 4th Layer: Ultraviolet Absorption Layer | |
| Gelatin | 1.58 |
| Ultraviolet ray absorber (UV-1) | 0.47 |
| Color-mixing preventive (Cpd-5) | 0.05 |
| Solvent (Solv-5) | 0.24 |
| 5th Layer: Red-sensitive Layer | |
| Silver chlorobromide emulsion (cubic grain size 0.36 μm, grain size distribution variation coefficient 0.11, includes locally present 1.6 mol % silver bromide in some parts on grain surfaces) | 0.21 |
| Gelatin | 1.34 |
| Cyan coupler (ExC) | 0.34 |
| Color image stabilizer (Cpd-6) | 0.17 |
| Color image stabilizer (Cpd-7) | 0.34 |
| Color image stabilizer (Cpd-9) | 0.04 |
| Solvent (Solv-4) | 0.37 |
| 6th Layer: Ultraviolet Absorption Layer | |
| Gelatin | 0.53 |
| Ultraviolet ray absorber (UV-1) | 0.16 |
| Color-mixing preventive (Cpd-5) | 0.02 |
| Solvent (Solv-5) | 0.08 |
| 7th Layer: Protective Layer | |
| Gelatin | 1.33 |
| Acryl-modified polyvinyl alcohol copolymer (modification degree 17%) | 0.17 |
| Liquid paraffin | 0.03 |

The following compounds were used.

(ExY) Yellow coupler

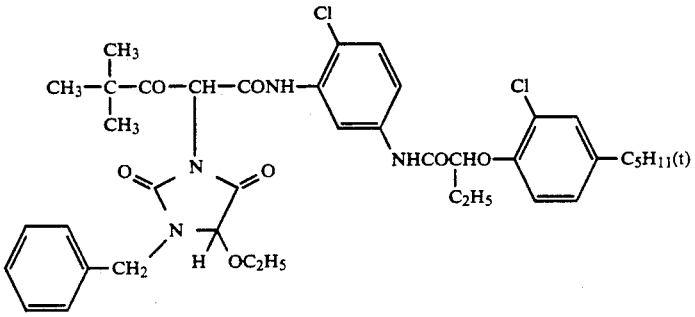

(ExM) Magenta coupler

-continued
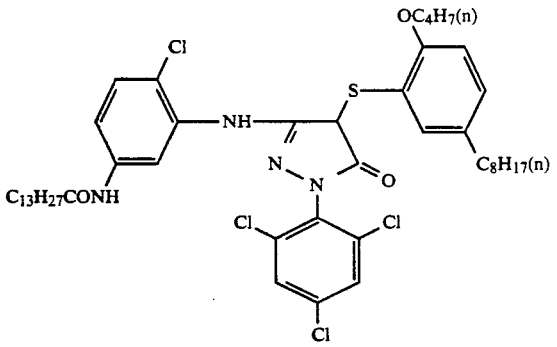
(ExC) Cyan coupler
A 1:3:6 mixture (by weight) of the following compounds, wherein R = H: R = $C_2H_5$: R = $C_4H_9$
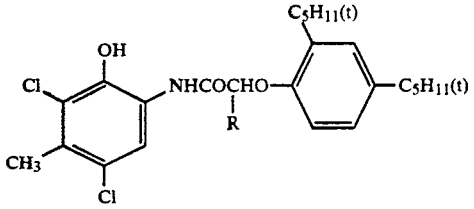
(Cpd-1) Color image stabilizer
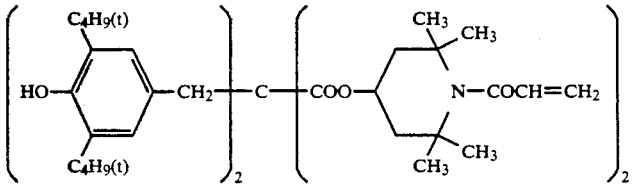
(Cpd-3) Color image stabilizer
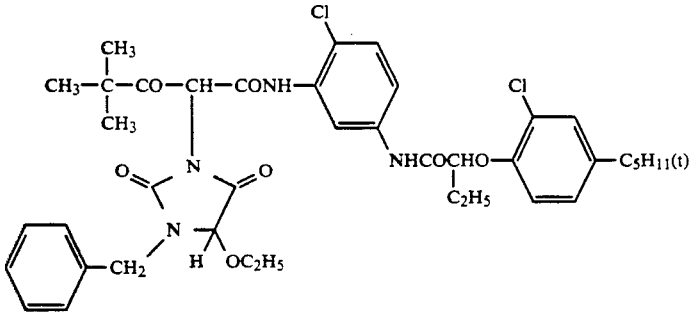
(Cpd-4) Color image stabilizer
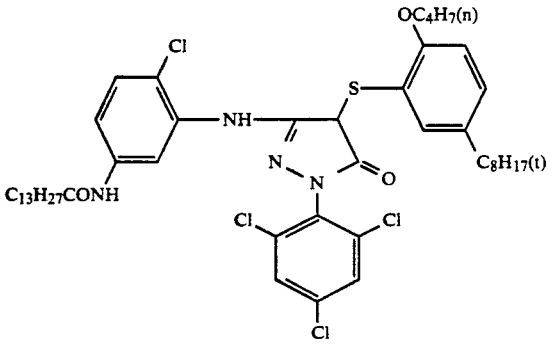
(Cpd-5) Color mixing preventive -continued
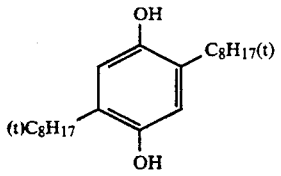
(Cpd-6) Color image stabilizer
2:4:4 mixture (by weight) of (A):(B):(C)
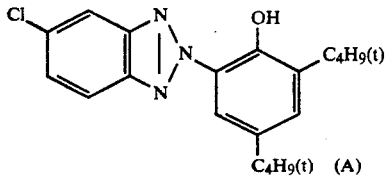
(A)
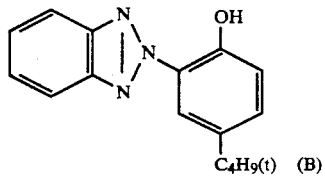
(B)
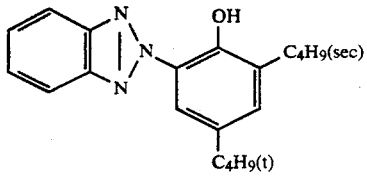
(C)
(Cpd-7) Color image stabilizer
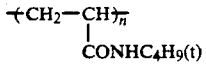
Average molecular weight 60,000
(Cpd-9) Color mixing preventive
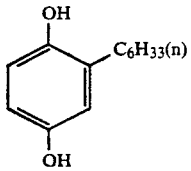
(UV-1) Ultraviolet absorbent
4:2:4 mixture (by weight) of (D):(E):(F)
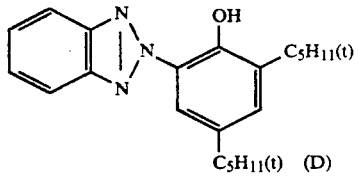
(D)
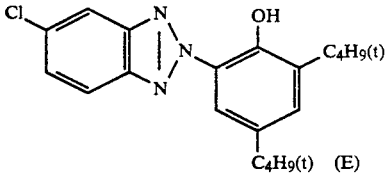
(E)
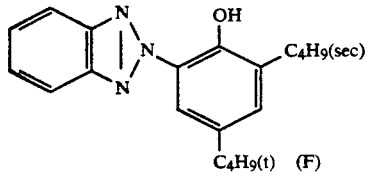
(F)
(Solv-1) Solvent
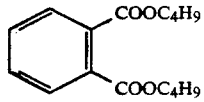
(Solv-2) Solvent
3:7 mixture (by weight) of -continued

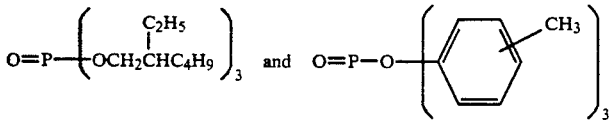

(Solv-3) Solvent
$O{=}P{-}(O{-}C_9H_{19}(iso))_3$ (Solv-4) Solvent

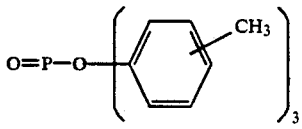

(Solv-5) Solvent

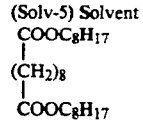

(Solv-6) Solvent

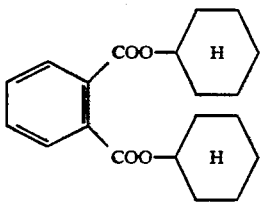

(Solv-7) Solvent

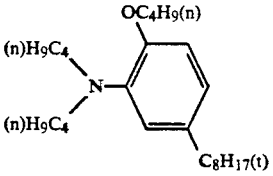

The sample material prepared in the manner indicated above was designated as F.

The following tests were conducted in order to investigate the photographic characteristics of this coating material F.

First, the coating material was subjected to graduated exposure for sensitometry using a sensitometer (FWH model manufactured by Fuji Photo Film Co., Ltd., light source color temperature 3200° K.). This was effected at exposures of 250 CMS for 1/10 second.

The coating material was processed in an automatic development machine by the processing stages and processing solutions noted below. The composition of the color development solution was varied in the manner indicated in Table 3.

| Processing Stage | Temperature | Time |
|---|---|---|
| Color development | 38° C. | 45 seconds |
| Bleach-fix | 30–36° C. | 45 seconds |
| Rinse (1) | 30–37° C. | 30 seconds |
| Rinse (2) | 30–37° C. | 30 seconds |
| Rinse (3) | 30–37° C. | 30 seconds |
| Drying | 70–80° C. | 60 seconds |

The compositions of the various processing solutions were as follows.

| | |
|---|---|
| Color Development Solution | |
| Water | 800 ml |
| Ethylenediamine-N,N,N,N,-tetra-methylenephosphonic acid | 3.0 g |
| Organic preservative A (See Table 3) | 0.03 mol |
| Sodium chloride | See Table 3 |
| Potassium bromide | See Table 3 |
| Potassium carbonate | 25 g |
| N-ethyl-N-(β-methanesulfonamidoethyl)-3-methyl-4-aminoaniline sulfite | 5.0 g |
| Triethanolamine | 10.0 g |
| Brightening agent (4,4'-diaminostilbene based) | 2.0 g |
| Sodium sulfite | 0.1 g |
| Water added | 1000 ml |
| pH (25° C.) | 10.05 |
| Bleach-fix Solution | |
| Water | 400 ml |
| Ammonium thiosulfate (70%) | 100 ml |
| Sodium sulfite | 17 g |
| Ferric(III) ammonium ethylene-diaminetetraacetate | 55 g |
| Disodium ethylenediaminetetraacetate | 5 g |
| Ammonium bromide | 40 g |
| Glacial acetic acid | 9 g |
| Water added | 1000 ml |
| pH (25° C.) | 5.40 |

Rinse Solution

Ion exchange water (both calcium and magnesium not more than 3 ppm)

Sensitometry processing as described above was effected and the blue (B) minimum density (Dmin) and maximum density (Dmax) were measured by means of a Macbeth densitometer. The results are shown in Table 3.

Sensitometry was similarly performed after the above development solution had been left to age for 2 weeks at room temperature open to air with an opening ratio (opening area/solution volume) of 0.02 $cm^{-1}$.The changes in the blue (B) minimum density that occurred over the period were determined by means of a Macbeth densitometer, as shown in Table 3.

The aged color development solution was also used for assessments of sensitization streaks as in Example 1. The assessment standards were in 4 stages, as follows.

| Sensitization Streak Assessment | Number of Sensitization Streaks in 100 $cm^2$ (10 cm × 10 cm) of Sample |
|---|---|
| ○ | 0 |
| Δ | 1-2 |
| x | 3-5 |
| xx | 6 or more |

marked suppression of occurrence of sensitization streaks.

It is also seen that there was marked suppression of increase in the minimum density, and suppression of fluctuation of photographic characteristics even with aging of the color development solution.

Further, in comparison with use of hydroxylamine, which is popular as an organic preservative for developing agents for silver chlorobromide photosensitive materials, use of the organic preservatives I-1 and II-19 was superior since it resulted in only a small change of the minimum density with aging of a development solution, and was also is very effective in preventing occurrence of sensitization streaks.

As seen in processing examples 6 to 12, if the chloride ion and bromide ion concentrations were lower than the concentrations of the invention, although the maximum density was high the minimum density also was high and an increase in the minimum density and occurrence of pressure sensitization streaks accompanying aging of the development solution occurred If the chlorine ion and bromine ion concentrations were higher than the concentrations of the invention, the minimum density was low and occurrence of pressure sensitization streaks was prevented but the maximum density was low, which means that these concentrations were unsuitable for rapid processing.

TABLE 3

| Processing I Example | 1 | 2 | 3 | 4 | 5 | 6 |
|---|---|---|---|---|---|---|
| Development Solution Chloride Ion Concentration (mole/l) | $3.5 \times 10^{-2}$ | $5.0 \times 10^{-2}$ | $1.0 \times 10^{-2}$ | $1.5 \times 10^{-2}$ | $1.0 \times 10^{-2}$ | $1.0 \times 10^{-2}$ |
| Development Solution Bromide Ion Concentration (mole/l) | $3.0 \times 10^{-5}$ | $5.0 \times 10^{-5}$ | $4.0 \times 10^{-4}$ | $1.0 \times 10^{-3}$ | $4.0 \times 10^{-4}$ | $4.0 \times 10^{-4}$ |
| Organic Preservative A | I-1 | I-1 | I-1 | I-1 | II-19 | |
| Remarks | Invention | Invention | Invention | Invention | Invention | Invention |
| BL Dmax (Before aging) | 2.48 | 2.48 | 2.47 | 2.40 | 2.53 | 2.36 |
| BL Dmin (After aging) | 0.07 | 0.07 | 0.07 | 0.07 | 0.07 | 0.08 |
| BL ΔDmin (Before/after aging) | +0.01 | ±0.00 | ±0.00 | ±0.00 | ±0.00 | +0.02 |
| Sensitization Streaks | ○ | ○ | ○ | ○ | ○ | Δ |

| Processing I Example | 7 | 8 | 9 | 10 | 11 | 12 |
|---|---|---|---|---|---|---|
| Development Solution Chloride Ion Concentration (mole/l) | — | $1.0 \times 10^{-2}$ | — | $5.0 \times 10^{-2}$ | $3.0 \times 10^{-1}$ | $1.0 \times 10^{-1}$ |
| Development Solution Bromide Ion Concentration (mole/l) | — | — | $4.0 \times 10^{-4}$ | $5.0 \times 10^{-3}$ | $5.0 \times 10^{-4}$ | $1.0 \times 10^{-2}$ |
| Organic Preservative A | I-1 | I-1 | I-1 | I-1 | I-1 | I-1 |
| Remarks | Comparison Example | Comparison Example | Comparison Example | Comparison Example | Comparison Example | Comparison Example |
| BL Dmax (Before aging) | 2.49 | 2.48 | 2.48 | 1.94 | 2.16 | 1.70 |
| BL Dmin (After aging) | 0.14 | 0.13 | 0.10 | 0.07 | 0.07 | 0.07 |
| BL ΔDmin (Before/after aging) | +0.06 | +0.05 | +0.04 | ±0.00 | +0.01 | ±0.00 |
| Sensitization Streaks | xx | xx | xx | ○ | Δ | ○ |

It is seen from Table 3 that in processing examples 1 to 6 in which processing was effected with development solutions of the invention, there were excellent photographic characteristics, since the maximum density was high and the minimum density was low and there was

EXAMPLE 3

The procedure in Example 2 was followed, except that in processing example 5, I-2, I-3, II-1, II-5, II-9, II-13 and II-20 were used instead of organic preservative A II-19. Similarly good results were obtained.

EXAMPLE 4

The procedure in Example 2 was followed, except that in processing example 5, III-3, III-11, IV-1 and IV-2 were used instead of triethanolamine in the development solution Similarly good results were obtained.

EXAMPLE 5

A multilayer color printing paper with the layer structure described below was prepared on a paper support laminated on both sides with polyethylene. The coating solutions were prepared as follows.

Preparation of 1st Layer Coating Solution 19.1 g of a yellow coupler (E×Y), 4.4 g of a color image stabilizer (Cpd-1) and 0.7 g of another color image stabilizer (Cpd-7) were dissolved by addition of 27.2 cc of ethyl acetate and 8.2 g of a solvent (Solv-3). This solution was emulsified and dispersed in 185 cc of a 10% gelatin aqueous solution containing 8 cc of 10% sodium dodecylbenzenesulfonate. Meanwhile, an emulsion was produced by adding to a silver chlorobromide emulsion (average cubic grain size 0.85 μm, cubic grains with a grain size distribution variation coefficient of 0.07 and having locally present 1.0 mol % silver bromide in some parts on grain surfaces) the two types of blue-sensitization dyes described below, in an amount that was $2.0\times10^{-4}$ moles per 1 mole of silver in each case, and effecting sulfur sensitization. This emulsion and the emulsified dispersion described above were mixed and dissolved to give a 1st coating solution with the composition noted below. The coating solutions of the 2nd to 7th layers were prepared in the same manner. 1-oxy-3,5-dichloro-s-triazine sodium salt was used as a gelatin hardener for each layer.

The following substances were used as spectral sensitization dyes in the various layers.

Blue-sensitive emulsion layer

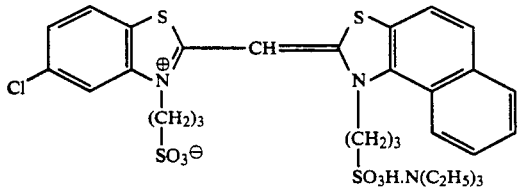

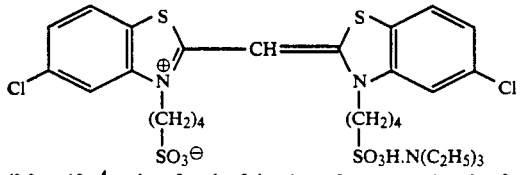

($2.0\times10^{-4}$ moles of each of the above 2 types per 1 mole of silver halide)

Green-sensitive emulsion layer

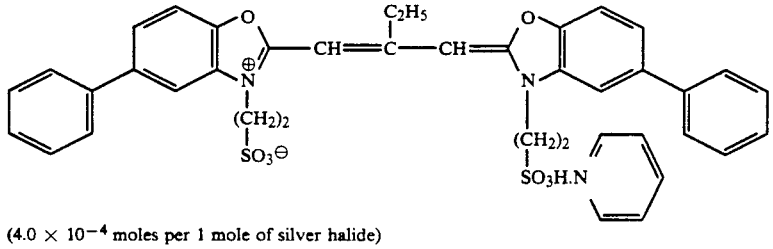

($4.0\times10^{-4}$ moles per 1 mole of silver halide)

and

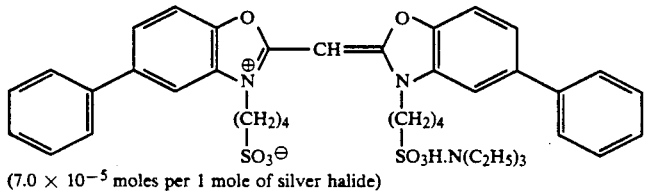

($7.0\times10^{-5}$ moles per 1 mole of silver halide)

Red-sensitive emulsion layer

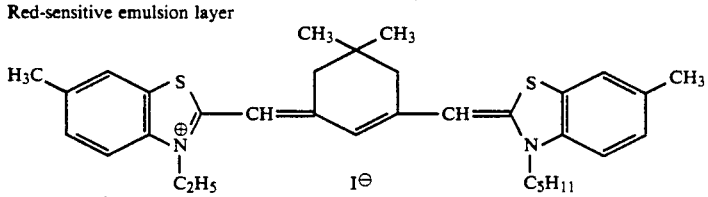

($0.9\times10^{-4}$ moles per 1 mole of silver halide)

The following compound was added to the red-sensitive emulsion layer in an amount that was $2.6\times20^{-3}$ moles per 1 mole of silver halide.

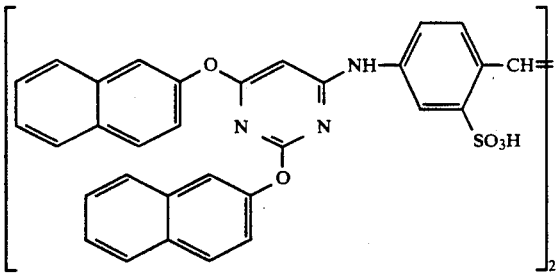

Also, to the blue-sensitive emulsion layer, green sensitive emulsion layer and red-sensitive emulsion layer were added 1-(5-methylureidophenyl)-5-mercaptotetrazole in amounts that were respectively $8.5\times10^{-5}$ moles, $7.7\times10^{-4}$ moles and $2.5\times10^{-5}$ moles per 1 mole of silver halide.

The following dyes were added to the emulsion layers to prevent irradiation.

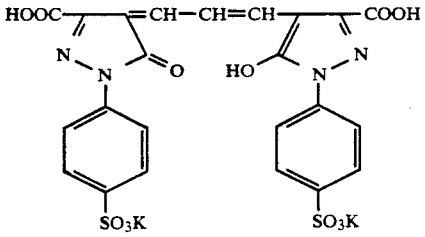

and

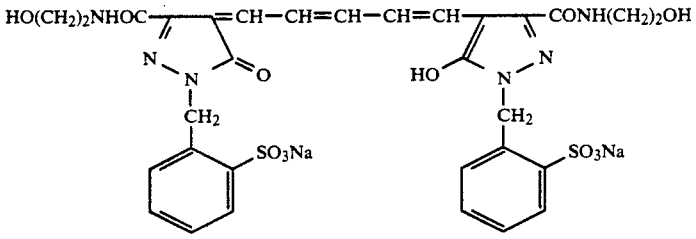

Layer Structure

The compositions of the various layers were as follows.

The figures indicate coating quantities (g/m$^2$). Coating quantitites calculated as silver are given for silver halide emulsions.

Support

Polyethylene-laminated paper.

(The polyethylene on the 1st layer side contained a white pigment ($TiO_2$) and a blue dye (ultramarine).)

| | |
|---|---|
| 1st Layer: Blue-sensitive Layer | |
| The silver chlorobromide emulsion described above | 0.30 |
| Gelatin | 1.86 |
| Yellow coupler (ExY) | 0.82 |
| Color image stabilizer (Cpd-1) | 0.19 |
| Color image stabilizer (Cpd-7) | 0.03 |
| Solvent (Solv-3) | 0.35 |
| 2nd Layer: Color-mixing Prevention Layer | |
| Gelatin | 0.99 |
| Color-mixing preventive (Cpd-5) | 0.08 |
| Solvent (Solv-1) | 0.16 |
| Solvent (Solv-4) | 0.08 |
| 3rd Layer: Green-sensitive Layer | |
| Silver chlorobromide emulsion (cubic grain size 0.40 μm, variation coefficient 0.09, including locally present 1 mol % silver bromide in some parts on grain surfaces) | 0.36 |
| Gelatin | 1.24 |
| Magenta coupler (ExM) | 0.31 |
| Color image stabilizer (Cpd-3) | 0.12 |
| Color image stabilizer (Cpd-4) | 0.06 |
| Color image stabilizer (Cpd-8) | 0.09 |
| Solvent (Solv-2) | 0.42 |
| 4th Layer: Ultraviolet Absorption Layer | |
| Gelatin | 0.58 |
| Ultraviolet ray absorber (UV-1) | 0.47 |
| Color-mixing preventive (Cpd-5) | 0.05 |
| Solvent (Solv-5) | 0.24 |
| 5th Layer: Red-sensitive Layer | |
| Silver chlorobromide emulsion (cubic grain size 0.36 μm, variation coefficient 0.11, including locally present 1.6 mol % silver bromide in some parts on grain surfaces) | 0.21 |
| Gelatin | 1.34 |
| Cyan coupler (ExC) | 0.34 |
| Color image stabilizer (Cpd-6) | 0.17 |
| Color image stabilizer (Cpd-7) | 0.34 |
| Color image stabilizer (Cpd-9) | 0.04 |
| Solvent (Solv-6) | 0.37 |
| 6th Layer: Ultraviolet Absorption Layer | |
| Gelatin | 0.53 |
| Ultraviolet ray absorber (UV-1) | 0.16 |
| Color-mixing preventive (Cpd-5) | 0.02 |
| Solvent (Solv-5) | 0.08 |
| 7th Layer: Protective Layer | |
| Gelatin | 1.33 |
| Acryl-modified polyvinyl alcohol copolymer (modification degree 17%) | 0.17 |
| Liquid paraffin | 0.03 |

The compounds used were as follows.

(ExY) Yellow coupler
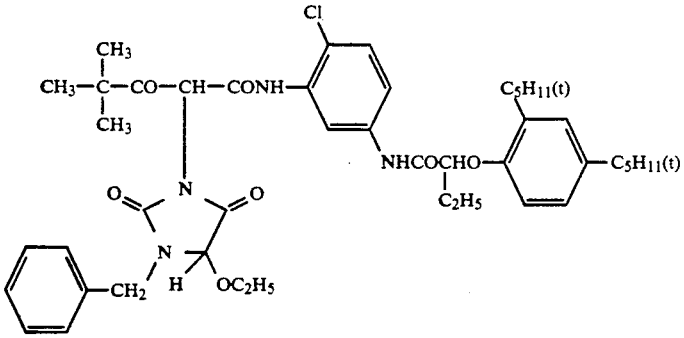
(ExM) Magenta coupler
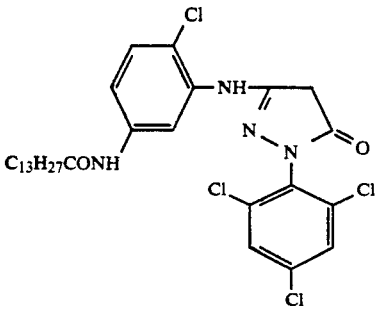
(ExC) Cyan coupler
A 1:3:6 mixture (by weight) of following compounds, wherein (R = H):(R = $C_2H_5$):(R = $C_4H_9$)
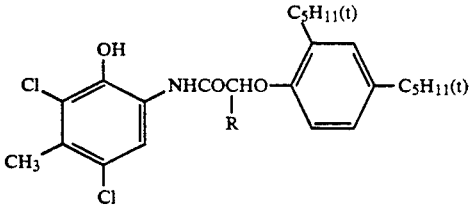
(Cpd-1) Color image stabilizer
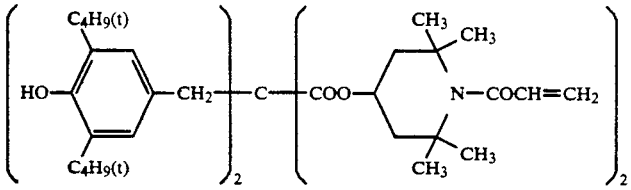
(Cpd-3) Color image stabilizer
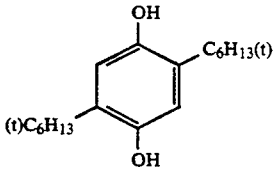
(Cpd-4) Color image stabilizer
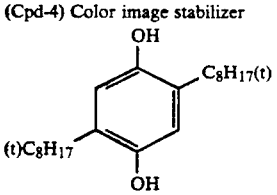
(Cpd-5) Color mixing preventive agent -continued
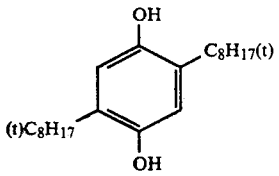
(Cpd-6) Color image stabilizer
2:4:4 mixture (by weight) of (G):(H):(J)
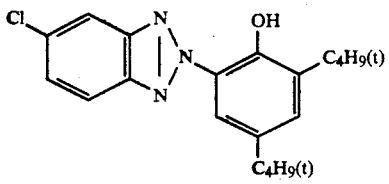
(G)
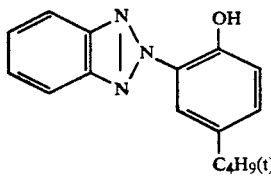
(H)
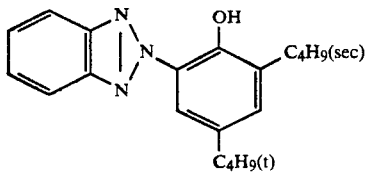
(J)
(Cpd-7) Color image stabilizer
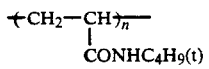
Average molecular weight 60,000
(Cpd-8) Color image stabilizer
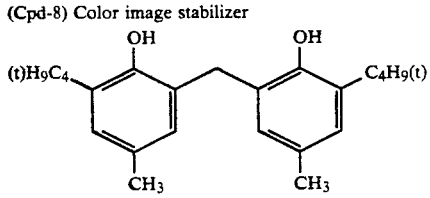
(Cpd-9) Color image stabilizer
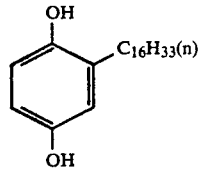
(UV-1) Ultraviolet absorbent
4:2:4 mixture (by weight) of (K):(L):(M)
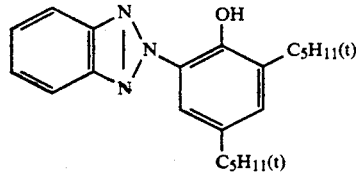
(K)

-continued

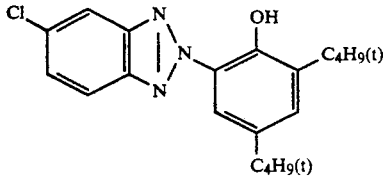

(L)

and

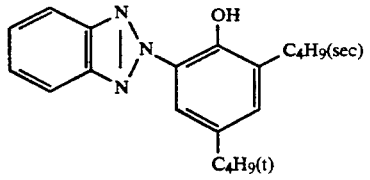

(M)

(Solv-1) Solvent

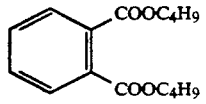

(Solv-2) Solvent
1:1 (volume ratio) mixture of

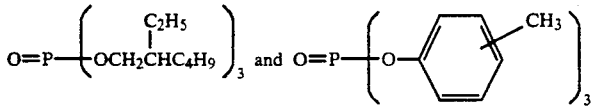

(Solv-3) Solvent
$O{=}P{+}O{-}C_9H_{19}(iso))_3$ (Solv-4) Solvent

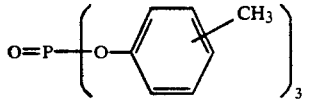

(Solv-5) Solvent
$COOC_8H_{17}$
$(CH_2)_8$
$COOC_8H_{17}$ (Solv-6) Solvent

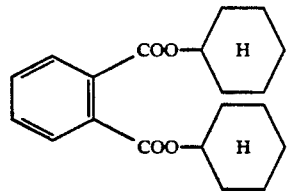

The sample material prepared in the manner indicated above was designated as G.

After image exposure of this sample material G, continuous processing (a running test) was conducted until up to 2 times the development tank volume had been replenished, using an automatic development machine for paper and the processing stages and processing compositions noted below.

The composition of the color development solution was varied in the manner indicated in Table 4.

| Processing Stage | Temperature | Time | Replenishment quantity | Tank Capacity |
|---|---|---|---|---|
| Color development | 38° C. | 45 sec | 109 ml | 4 l |
| Bleach-fixing | 30–36° C. | 45 sec | 215 ml | 4 l |
| Stabilization (1) | 30–37° C. | 20 sec | — | 2 l |
| Stabilization (2) | 30–37° C. | 20 sec | — | 2 l |
| Stabilization (3) | 30–37° C. | 20 sec | 364 ml | 2 l |
| Drying | 70–85° C. | 60 sec | | |

*The replenishment quantity per 1 $m^2$ of photosensitive material (A 3-tank counterflow system going from stabilization tank (1) to (3) was used.)

The compositions of the various processing solutions were as follows.

| | Tank Solution | Replenisher Solution |
|---|---|---|
| Color Development Solution | | |
| Water | 800 ml | 800 ml |
| Ethylenediaminetetraacetic acid | 5.0 g | 5.0 g |
| 5,6-Dihydroxybenzene-1,2,4-trisulfonic acid | 0.3 g | 0.3 g |
| Triethanolamine | 8.0 g | 8.0 g |
| Sodium chloride | See Table 4 | |
| Potassium bromide | See Table 4 | |
| Potassium carbonate | 25 g | 25 g |
| Organic preservative A (See Table 4) | 0.03 mol | 0.05 mol |
| N-ethyl-N-(β-methanesulfonamidoethyl)-3-methyl-4-amino aniline sulfate | | |
| Sulfuric acid salt | 5.0 g | 9.5 g |
| Sodium sulfite | 0.1 g | 0.2 g |
| Brightening agent (Diaminostilbene agent 'WHITEX-4' manufactured by Sumitomo Kagaku) | 1.0 g | 2.5 g |
| Water added | 1000 ml | 1000 ml |
| pH (25° C.) | 10.05 | 10.60 |
| Bleach-fix Solution (Same for both tank solution and replenisher solution) | | |
| Water | | 400 ml |
| Ammonium thiosulfate (70%) | | 100 ml |
| Sodium sulfite | | 17 g |
| Ferric (III) ammonium ethylenediaminetetraacetate | | 55 g |
| Disodium ethylenediaminetetraacetate | | 5 g |
| Glacial acetic acid | | 9 g |
| Water added | | 1000 ml |
| pH (25° C.) | | 5.40 |
| Stabilization Solution (Same for both tank solution and make-up solution) | | |
| Formalin (37%) | | 0.1 g |
| Formalin - sulfite adduct | | 0.7 g |
| 5-Chloro-2-methyl-4-isothiazolin-3-one | | 0.02 g |
| 2-Methyl-4-isothiazolin-3-one | | 0.01 g |
| Copper sulfate | | 0.005 g |
| Aqueous ammonia (28%) | | 2.0 ml |
| Water added | | 1000 ml |
| pH (25° C.) | | 4.0 |

The chloride ion concentration and bromide ion concentration in the replenishment solution were set such that the tank solution concentrations were maintained from the start to the end of the running processing.

The above sample coating material was subjected to graduated exposure for sensitometry using a sensitometer (FWH model manufactured by Fuji Photo Film Co., Ltd., light source color temperature 3200° K.). This was effected at exposures of 250 CMS for 1/10 second.

Sensitometry as above was performed at the start and at the end of the running tests and a Macbeth densitometer was used to determine the blue (B) minimum density (Dmin) and maximum density (Dmax) on performance of the running test and the amount of change in the blue (B) minimum density that accompanied continuous processing (value at the end of the running test minus the value at the start of the running test). The results are noted in Table 4.

The photosensitive material was also subjected to exposure to uniform light such as to make 90% of the coated silver developed silver and then, at the end of the running test, it was processed and the amount of developed silver and the amount of residual silver were determined by X ray fluorometry. The results are given in Table 4.

Further, at the end of the running test, the sample coating material was subjected to assessment of sensitization streaks in the same way as in Example 1. The assessment standards were in 4 stages as follows.

| Sensitization Streak Assessment | Number of Sensitization Streaks in 100 $cm^2$ (10 cm × 10 cm) of Sample |
|---|---|
| ○ | 0 |
| Δ | 1-2 |
| x | 3-5 |
| xx | 6 or more |

The results are given in Table 4.

TABLE 4

| | | Processing I Example | | | | | |
|---|---|---|---|---|---|---|---|
| | | 1 | 2 | 3 | 4 | 5 | 6 |
| Development Solution Chloride Ion Concentration (mol/l) | Tank Solution | $4.6 \times 10^{-2}$ | $1.0 \times 10^{-1}$ | $1.5 \times 10^{-1}$ | $4.6 \times 10^{-2}$ | $4.6 \times 10^{-2}$ | $4.6 \times 10^{-2}$ |
| | Replenishment Solution | — | $5.5 \times 10^{-2}$ | $1.0 \times 10^{-1}$ | — | — | — |
| Development Solution Bromide Ion Concentration (mol/l) | Tank Solution | $1.3 \times 10^{-4}$ | $5.0 \times 10^{-4}$ | $1.0 \times 10^{-3}$ | $1.3 \times 10^{-4}$ | $5.0 \times 10^{-4}$ | $1.3 \times 10^{-4}$ |
| | Replenishment Solution | — | $3.7 \times 10^{-4}$ | $8.7 \times 10^{-4}$ | — | $3.7 \times 10^{-4}$ | — |
| Organic preservative A | | I-1 | I-1 | I-1 | II-19 | II-19 | Hydroxyl amine |
| Remarks | | Invention | Invention | Invention | Invention | Invention | Comparison Example |
| At start of running test | BL Dmax | 2.38 | 2.38 | 2.37 | 2.43 | 2.42 | 2.30 |
| | BL Din | 0.08 | 0.08 | 0.08 | 0.08 | 0.08 | 0.09 |
| BL ΔDmin (Value at end minus value at start) | | +0.01 | ±0.00 | ±0.00 | ±0.00 | ±0.00 | +0.02 |
| Residual silver (μg/$cm^2$) | | 1.3 | 1.4 | 1.6 | 1.2 | 1.4 | 2.8 |
| Sensitization Streaks | | ○ | ○ | ○ | ○ | ○ | Δ |

| | | Processing I Example | | | | | |
|---|---|---|---|---|---|---|---|
| | | 7 | 8 | 9 | 10 | 11 | 12 |
| Development Solution | Tank Solution | $5.0 \times 10^{-1}$ | $5.4 \times 10^{-2}$ | $5.0 \times 10^{-1}$ | $5.0 \times 10^{-1}$ | $5.4 \times 10^{-2}$ | $5.0 \times 10^{-1}$ |

TABLE 4-continued

| | | | | | | | |
|---|---|---|---|---|---|---|---|
| Chloride Ion Concentration (mol/l) | Replenishment Solution | $4.5 \times 10^{-1}$ | $0.8 \times 10^{-2}$ | $4.5 \times 10^{-1}$ | $4.5 \times 10^{-1}$ | $0.8 \times 10^{-2}$ | $4.9 \times 10^{-1}$ |
| Development Solution | Tank Solution | $1.7 \times 10^{-4}$ | $5.9 \times 10^{-3}$ | $5.9 \times 10^{-3}$ | $1.7 \times 10^{-4}$ | $5.9 \times 10^{-3}$ | $5.9 \times 10^{-3}$ |
| Bromide Ion Concentration (mol/l) | Replenishment Solution | $0.4 \times 10^{-4}$ | $5.8 \times 10^{-3}$ | $5.8 \times 10^{-3}$ | $0.4 \times 10^{-4}$ | $5.8 \times 10^{-3}$ | $5.8 \times 10^{-3}$ |
| Organic preservative A | | I-1 | I-1 | I-1 | Hydroxyl amine | Hydroxyl amine | Hydoxyl amine |
| Remarks | | Comparison | Comparison | Comparison | Comparison Example | Comparison Example | Comparison Example |
| At start of running test | BL Dmax | 2.09 | 1.89 | 1.71 | 1.98 | 1.76 | 1.66 |
| | BL Din | 0.08 | 0.08 | 0.08 | 0.09 | 0.09 | 0.08 |
| BL ΔDmin (Value at end minus value at start) | | +0.01 | ±0.00 | ±0.00 | +0.02 | +0.02 | +0.01 |
| Residual silver ($\mu g/cm^2$) | | 6.6 | 9.9 | 10.8 | 7.2 | 11.1 | 12.6 |
| Sensitization Streaks | | ○ | ○ | ○ | Δ | Δ | Δ |

It is apparent from Table 4 that in processing examples 1 to 6 in which processing was effected with development solutions of the invention, there were excellent photographic characteristics, since the maximum density was high and the minimum density was low, and that continuous processing was accompanied by hardly any increase in the minimum density.

The results were also good since the amount of residual silver was small and there were good sensitization streak prevention effects.

Use of the organic preservatives I-1 and II-19 gave still more desirable results, since in addition to the maximum density being higher and continuous processing being accompanied by little change in the minimum density, there was a reduction of residual silver and there were good pressure sensitization streak prevention effects.

As seen in processing example 6 to 12, when the chlorine ion concentration and bromine ion concentration were higher than the concentrations of the invention, the minimum density was low and pressure sensitization streaks were prevented by the maximum density was low and there was a large amount of residual silver, so such conditions were unsuitable for rapid processing.

EXAMPLE 6

The same procedure was used as in Example 5 except that in processing example 4, I-2, I-3, II-1, II-5, II-9, II-13 and II-20 were used instead of organic preservative A II-19. Similarly good results were obtained.

EXAMPLE 7

The same procedure as in Example 2 was followed except that in processing example 5, III-3, III-11, IV-1 and IV-2 were used instead of triethanolamine in the development solution similarly gave good results.

EXAMPLE 8

A multilayer color printing paper with the layer structure described below was prepared on a paper support laminated on both sides with polyethylene. The coating solutions were prepared as follows.

Preparation of 1st Layer Coating Solution 19.1 g of a yellow coupler (E×Y), 4.4 g of a color image stabilizer (Cpd-1) and 0.7 g of another color image stabilizer (Cpd-7) were dissolved by addition of 27.2 cc of ethyl acetate and 8.2 g of a solvent (Solv-3). This solution was emulsified and dispersed in 185 cc of a 10% gelatin aqueous solution containing 8 cc of 10% sodium dodecylbenzenesulfonate. Meanwhile, an emulsion was produced by adding to a silver chlorobromide emulsion (average cubic grain size 0.88 μm, cubic grains with a grain size distribution variation coefficient of 0.08 and having locally present 0.2 mol % silver bromide in some parts on grain surfaces) the two types of blue-sensitization dyes described below, in an amount that was $2.0 \times 10^{-4}$ moles per 1 mole of silver in each case, and effecting sulfur sensitization. This emulsion and the emulsified dispersion described above were mixed and dissolved to give a 1st coating solution with the composition noted below. The coating solutions of the 2nd to 7th layers were prepared in the same manner. 1-Oxy-3,5-dichloro-s-triazine sodium salt was used as a gelatin hardener for each layer.

The following substances were used as spectral sensitization dyes in the various layers.

Blue-sensitive emulsion layer

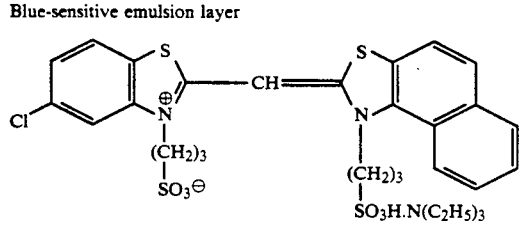

-continued

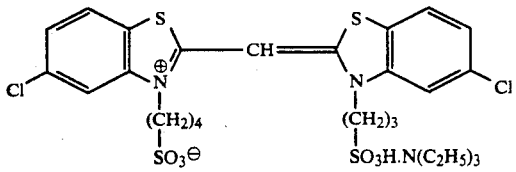

(2.0 × $10^{-4}$ moles of each of the above 2 types per 1 mole of silver halide)

Green-sensitive emulsion layer

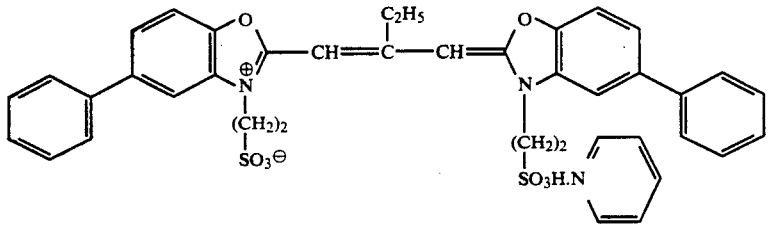

(4.0 × $10^{-4}$ moles per 1 mole of silver halide)

and

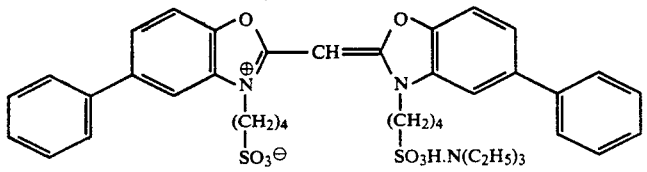

(7.0 × $10^{-5}$ moles per 1 mole of silver halide)

Red-sensitive emulsion layer

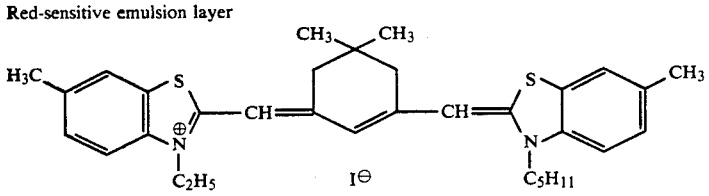

(0.9 × $10^{-4}$ moles per 1 mole of silver halide)

The following compound was added to the red-sensitive emulsion layer in an amount that was $2.6\times10^{-3}$ moles per 1 mole of silver halide)

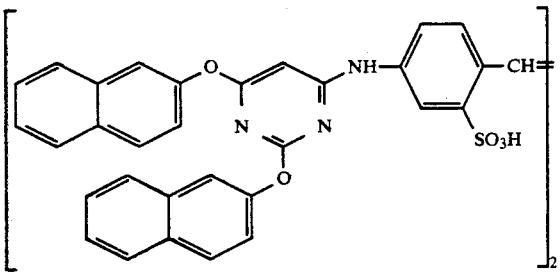

Also, to the blue-sensitive emulsion layer, green-sensitive emulsion layer and red-sensitive emulsion layer were added 1-(5-methylureidophenyl)-5-mercaptotetrazole in amounts that were respectively $8.5\times10^{-5}$ moles, $7.7\times10^{-4}$ moles and $2.5\times10^{-5}$ moles per 1 mole of silver halide.

The following dyes were added to the emulsion layers to prevent irradiation.

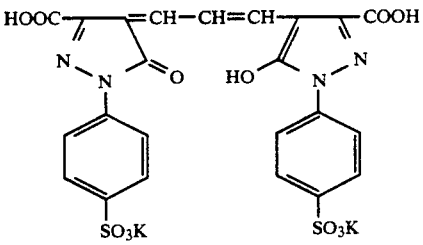

-continued and

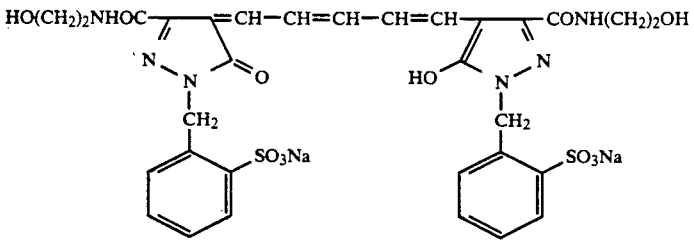

Layer Structure

The compositions of the various layers were as follows. The figures indicate coating quantities (g/m$^2$). Coating quantities calculated as silver are given for silver halide emulsions.

Support

Polyethylene-laminated paper.

(The polyethylene on the 1st layer side contains a white pigment ($TiO_2$) and a blue dye (ultramarine).)

| | |
|---|---|
| 1st Layer: Blue-sensitive Layer | |
| Silver chlorobromide emulsion described above | 0.30 |
| Gelatin | 1.86 |
| Yellow coupler (ExY) | 0.82 |
| Color image stabilizer (Cpd-1) | 0.19 |
| Solvent (Solv-3) | 0.35 |
| Color image stabilizer (Cpd-7) | 0.06 |
| 2nd Layer: Color-mixing Prevention Layer | |
| Gelatin | 0.99 |
| Color-mixing preventive (Cpd-5) | 0.08 |
| Solvent (Solv-1) | 0.16 |
| Solvent (Solv-4) | 0.08 |
| 3rd Layer: Green-sensitive Layer | |
| Silver chlorobromide emulsion (1:3 (Ag moles ratio) mixture of cubic grains with average grain size of 0.55μ and 0.39 μm, grain size distribution variation coefficients respectively 0.10 and 0.08; 0.8 mol % AgBr are present locally on grain surfaces) | 0.12 |
| Gelatin | 1.24 |

-continued

| | |
|---|---|
| Magenta coupler (ExM) | 0.27 |
| Color image stabilizer (Cpd-3) | 0.15 |
| Color image stabilizer (Cpd-8) | 0.02 |
| Color image stabilizer (Cpd-9) | 0.03 |
| Solvent (Solv-2) | 0.54 |
| 4th Layer: Ultraviolet Absorption Layer | |
| Gelatin | 1.58 |
| Ultraviolet ray absorber (UV-1) | 0.47 |
| Color-mixing preventive (Cpd-5) | 0.05 |
| Solvent (Solv-5) | 0.24 |
| 5th Layer: Red-sensitive Layer | |
| Silver chlorobromide emulsion (1:4 (Ag moles ratio) mixture of cubic grains with average grain size of 0.58μ and 0.45 μm, grain size distribution variation coefficients respectively 0.09 and 0.11; 0.6 mol % AgBr are present locally on grain surfaces) | 0.23 |
| Gelatin | 1.34 |
| Cyan coupler (ExC) | 0.32 |
| Color image stabilizer (Cpd-6) | 0.17 |
| Color image stabilizer (Cpd-10) | 0.04 |
| Color image stabilizer (Cpd-7) | 0.40 |
| Solvent (Solv-6) | 0.15 |
| 6th Layer: Ultraviolet Absorption Layer | |
| Gelatin | 0.53 |
| Ultraviolet ray absorber (UV-1) | 0.16 |
| Color-mixing preventive (Cpd-5) | 0.02 |
| Solvent (Solv-5) | 0.08 |
| 7th Layer: Protective Layer | |
| Gelatin | 1.33 |
| Acryl-modified polyvinyl alcohol copolymer (modification degree 17%) | 0.17 |
| Liquid paraffin | 0.03 |

The compounds used were as follows.

(ExY) Yellow coupler

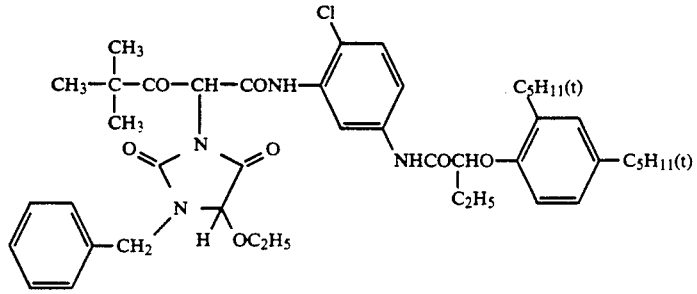

(ExM) Magenta coupler

-continued
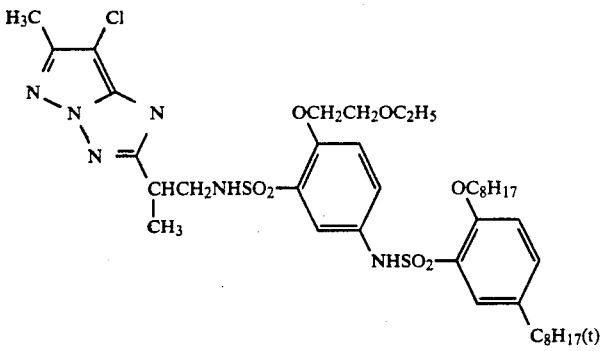
(ExC) Cyan coupler
A 2:4:4 mixture (by weight) of (Compound (N) wherein R = $C_2H_5$):(Compound (N) wherein R = $C_4H_9$):(O)
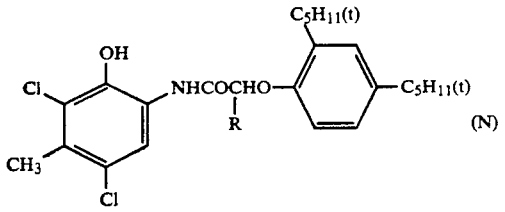
(N)
R = $C_2H_5$, $C_4H_9$
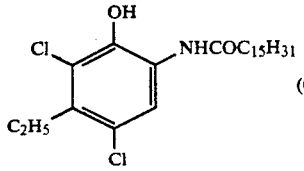
(O)
(Cpd-1) Color image stabilizer
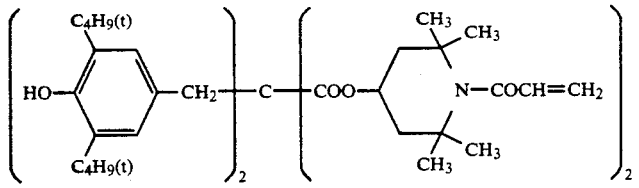
(Cpd-3) Color image stabilizer
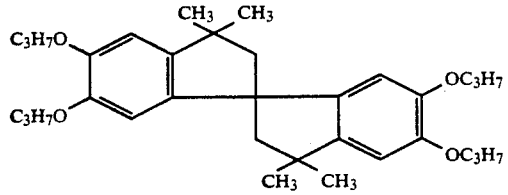
(Cpd-5) Color mixing preventive
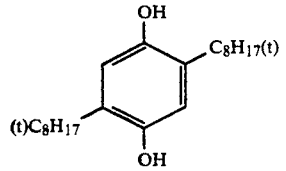
(Cpd-6) Color image stabilizer
2:4:4 mixture (by weight) of (P):(Q):(R)

-continued
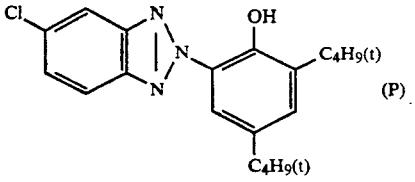
(P)
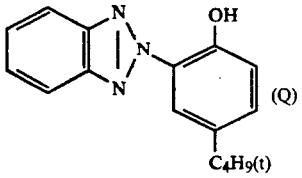
(Q)
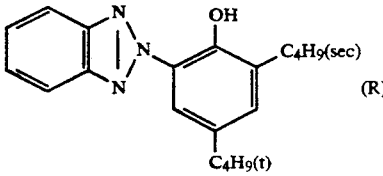
(R)
(Cpd-7) Color image stabilizer
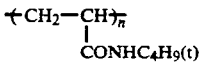
Average molecular weight 60,000
(Cpd-8) Color image stabilizer
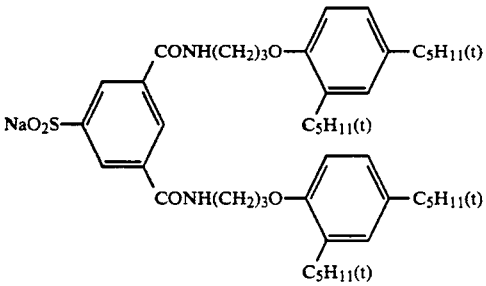
(Cpd-9) Color image stabilizer
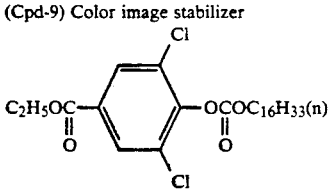
(Cpd-10) Color image stabilizer
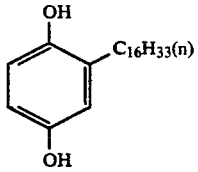
(UV-1) Ultraviolet absorbent
4:2:4 mixture (by weight) of (S):(T):(U)
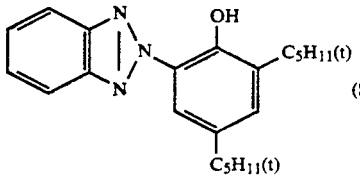
(S)

-continued

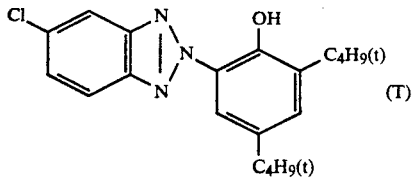

(T)

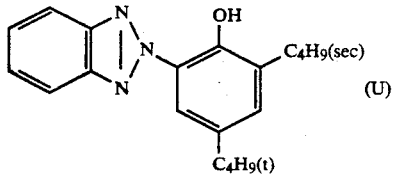

(U)

(Solv-1) Solvent

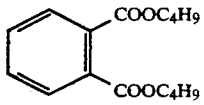

(Solv-2) Solvent
2:1 (by volume) mixture of

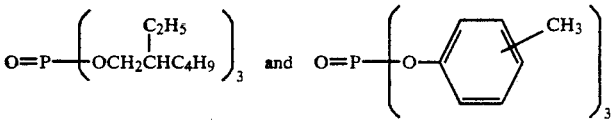

(Solv-3) Solvent
$O{=}P{\leftarrow}O{-}C_9H_{19}(iso))_3$ (Solv-4) Solvent

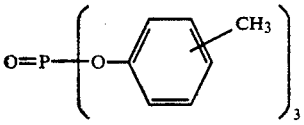

(Solv-5) Solvent
$COOC_8H_{17}$
|
$(CH_2)_8$
|
$COOC_8H_{17}$ (Solv-6) Solvent

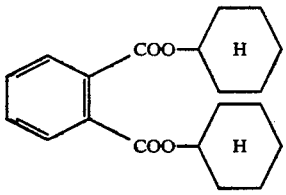

The sample material thus prepared was designated as H.

Next, samples H to L were prepared by following the same procedure as for H but varying the amounts of coated silver in the various emulsion layers to the values noted in Table 5.

TABLE 5

| Coating Sample | Coated Silver Quantity ($g/m^2$) | | | |
|---|---|---|---|---|
| | B | G | R | Total |
| H | 0.30 | 0.12 | 0.23 | 0.65 |
| I | 0.32 | 0.18 | 0.25 | 0.75 |
| J | 0.34 | 0.19 | 0.27 | 0.80 |
| K | 0.37 | 0.22 | 0.31 | 0.90 |

TABLE 5-continued

| Coating Sample | Coated Silver Quantity ($g/m^2$) | | | |
|---|---|---|---|---|
| | B | G | R | Total |
| L | 0.40 | 0.25 | 0.35 | 1.00 |

After image exposure of samples H to L, continuous processing (a running test) was conducted until up to 2 times the development tank's volume had been replenished, using an automatic development machine for paper and the processing stages and processing compositions noted below.

| Processing Stage | Temperature | Time | Replenishment quantity | Tank Capacity |
|---|---|---|---|---|
| Color development | 38° C. | 45 sec | See Table 6 | 4 l |
| Bleach-fixing | 30–36° C. | 45 sec | 61 ml | 4 l |
| Washing (1) | 30–37° C. | 30 sec | — | 2 l |
| Washing (2) | 30–37° C. | 30 sec | — | 2 l |
| Washing (3) | 30–37° C. | 30 sec | 364 ml | 2 l |
| Drying | 70–85° C. | 60 sec | | |

*The replenishment quantity per 1 $m^2$ of photosensitive material (A 3-tank counterflow system running from washing tank (1) to (3) was used. The bleach-fix bath was replenished with 122 ml of washing (1) solution per 1 $m^2$ of photosensitive material.)

The compositions of the various processing solutions were as follows.

| Color Development Solution (Tank Solution) | |
|---|---|
| Water | 800 ml |
| Ethylenediamine-N,N,N',N'-tetramethylenephosphonic acid | 3.0 g |
| Triethanolamine | 8.0 g |
| Sodium chloride | See Table 6 |
| Potassium bromide | See Table 6 |
| Potassium carbonate | 25 g |
| N-ethyl-N-(β-methanesulfonamidoethyl)-3-methyl-4-aminoaniline sulfate sulfuric acid salt | 5.0 g |
| Organic preservative A (II-19) | 0.03 mol |
| Brightening agent (WHITEX-4 manufactured by Sumitomo Kagaku) | 1.0 g |
| Water added | 1000 ml |
| pH (25° C.) | 10.05 |

| Bleach-fix Solution | |
|---|---|
| Water | 400 ml |
| Ammonium thiosulfate (70%) | 100 ml |
| Ammonium sulfite | 38 g |
| Ferric (III) ammonium ethylenediaminetetraacetate | 55 g |
| Disodium ethylenediaminetetraacetate | 5 g |
| Glacial acetic acid | 9 g |
| Water added | 1000 ml |
| pH (25° C.) | 5.40 |
| (Replenishment solution) | |
| The solution was concentrated in 2.5 times of the tank solution. | |
| Washing Water (Same for both tank solution and replenisher solution) | |
| Ion exchange purified water (both calcium and magnesium at 3 ppm or less) | |

During continuous processing, corrections of concentration due to evaporation were made by adding to the color development solution, bleach-fix solution and washing solution additions of distilled water corresponding to the amounts of evaporated water.

The above sample coating material was subjected to graduated exposure for sensitometry using a sensitometer (FWH model manufactured by Fuji Photo Film Co., Ltd., light source color temperature 3200° K.). This was effected at exposures of 250 CMS for 1/10 second.

Sensitometry as above was performed at the start and at the end of the running tests and a Macbeth densitometer was used to determine the blue (B) minimum density (Dmin) and maximum density (Dmax) on performance of the running test and the amount of change in the blue (B) minimum density that accompanied continuous processing (value at the end of the running test minus value at the start of the running test). The results are described in Table 6.

The photosensitive material was also subjected to exposure to uniform light such sufficient to make 90% of the coated silver developed silver and then, at the end of the running test, it was processed and the amount of developed silver and the amount of residual silver were determined by X ray fluorometry. Findings are given in Table 6.

| | Replenishment Solution (a) | Replenishment Solution (b) | Replenishment Solution (c) | Replenishment Solution (d) |
|---|---|---|---|---|
| Developer Replenishment Solution | | | | |
| Ethylenediamine-N,N,N',N'-tetra-methylenephosphonic acid | 3 (g/l) | 3(g/l) | 3 (g/l) | 5 (g/l) |
| Triethanolamine | 12 (g/l) | 12(g/l) | 12 (g/l) | 12 (g/l) |
| Potassium chloride | See table 6 | See Table 6 | See table 6 | See Table 6 |
| Potassium bromide | See table 6 | See Table 6 | See table 6 | See Table 6 |
| Potassium carbonate | 26 (g/l) | 26(g/l) | 26 (g/l) | 26 (g/l) |
| N-Ethyl-N-(β-methanesulfon amidoethyl)-3-methyl-4-aminoaniline sulfate | 6 (g/l) | 7(g/l) | 9 (g/l) | 15 (g/l) |
| Organic preservative (II-19) | 6 (g/l) | 6(g/l) | 7 (g/l) | 9 (g/l) |
| Brightening agent (WHITEX-4 manufactured by Sumitomo Kagaku) | 1.5 (g/l) | 2(g/l) | 2.5 (g/l) | 3 (g/l) |
| pH (25° C.) (adjusted with KOH or $H_2SO_4$) | 10.35 | 10.45 | 10.55 | 11.00 |

Further, at the end of the running test, the sample coating material was subjected to assessment of sensitization streaks in the same way as in Example 1. The assessment standards were in 4 stages as follows.

| Sensitization Streak Assessment | Number of Sensitization Streaks in 100 $cm^2$ (10 cm × 10 cm) of Sample |
|---|---|
| ○ | 0 |
| Δ | 1–2 |
| X | 3–5 |
| XX | 6 or more |

The assessment findings are given in Table 4.

TABLE 6

| | Processing I Example |
|---|---|

TABLE 6-continued

| | | 1 | 2 | 3 | 4 | 5 | 6 | 7 |
|---|---|---|---|---|---|---|---|---|
| Coating Sample | | H | H | H | H | H | H | H |
| Replenishment Solution | | (c) | (c) | (c) | (c) | (a) | (b) | (c) |
| Replenishment quantity (per 1 $m^2$ of photosensitive material) | | 100 ml | 100 ml | 100 ml | 100 ml | 300 ml | 200 ml | 100 ml |
| Development Solution | Tank Solution | $4.3 \times 10^{-2}$ | $5.0 \times 10^{-1}$ | $1.0 \times 10^{-1}$ | $1.5 \times 10^{-1}$ | $3.6 \times 10^{-2}$ | $6 \times 10^{-2}$ | $6 \times 10^{-2}$ |
| Chloride Ion Concentration (mol/l) | Replenishment Solution | — | $0.7 \times 10^{-2}$ | $5.7 \times 10^{-2}$ | $1.0 \times 10^{-2}$ | $2.2 \times 10^{-2}$ | $4 \times 10^{-2}$ | $1.7 \times 10^{-2}$ |
| Development Solution | Tank Solution | $1.2 \times 10^{-4}$ | $5.0 \times 10^{-4}$ | $1.0 \times 10^{-3}$ | $1.0 \times 10^{-3}$ | $4.0 \times 10^{-5}$ | $2 \times 10^{-4}$ | $2 \times 10^{-4}$ |
| Bromide Ion Concentration (mol/l) | Replenishment Solution | — | $3.8 \times 10^{-4}$ | $9.0 \times 10^{-4}$ | $9.0 \times 10^{-4}$ | $2.0 \times 10^{-5}$ | $1.4 \times 10^{-4}$ | $8 \times 10^{-5}$ |
| Remarks | | Invention | Invention | Invention | Invention | Invention | Invention | Invention |
| At start | BL Dmax | 2.30 | 2.30 | 2.24 | 2.20 | 2.31 | 2.30 | 2.30 |
| | BL Dmin | 0.07 | 0.07 | 0.07 | 0.07 | 0.08 | 0.07 | 0.07 |
| BL ΔDmin (Value at end minus value at start) | | +0.01 | ±0.00 | ±0.00 | ±0.00 | +0.02 | ±0.00 | ±0.00 |
| Residual silver (μg/$m^2$) | | 1.0 | 1.0 | 1.9 | 2.4 | 2.5 | 1.0 | 1.0 |
| Sensitization Streaks | | ○ | ○ | ○ | ○ | ○ | ○ | ○ |

| | | Processing I Example | | | | | | |
|---|---|---|---|---|---|---|---|---|
| | | 8 | 9 | 10 | 11 | 12 | 13 | 14 |
| Coating Sample | | H | H | I | J | K | L | H |
| Replenishment Solution | | (d) | (c) | (c) | (c) | (c) | (c) | (a) |
| Replenishment quantity (per 1 $m^2$ of photosensitive material) | | 30 ml | 100 ml | 100 ml | 100 ml | 100 ml | 100 ml | 300 ml |
| Development Solution | Tank Solution | $1.2 \times 10^{-1}$ | $7 \times 10^{-2}$ | $7 \times 10^{-2}$ | $7 \times 10^{-2}$ | $7 \times 10^{-2}$ | $7 \times 10^{-2}$ | $1.4 \times 10^{-2}$ |
| Chloride Ion Concentration (mol/l) | Replenishment Solution | | $2.7 \times 10^{-2}$ | $2.5 \times 10^{-2}$ | $2.2 \times 10^{-2}$ | $2.0 \times 10^{-2}$ | $1.7 \times 10^{-2}$ | — |
| Development Solution | Tank Solution | $7 \times 10^{-4}$ | $2.5 \times 10^{-4}$ | $2.5 \times 10^{-4}$ | $2.5 \times 10^{-4}$ | $2.5 \times 10^{-4}$ | $2.5 \times 10^{-4}$ | $2.0 \times 10^{-5}$ |
| Bromide Ion Concentration (mol/l) | Replenishment Solution | $3.5 \times 10^{-4}$ | $1.3 \times 10^{-4}$ | $1.0 \times 10^{-4}$ | $0.6 \times 10^{-4}$ | $0.3 \times 10^{-4}$ | — | — |
| Remarks | | Invention | Invention | Invention | Invention | Invention | Invention | Comparison Example |
| At start | BL Dmax | 2.21 | 2.30 | 2.31 | 2.30 | 2.25 | 2.20 | 2.30 |
| | BL Dmin | 0.07 | 0.07 | 0.07 | 0.07 | 0.08 | 0.08 | 0.09 |
| BL ΔDmin (Value at end minus value at start) | | +0.02 | ±0.00 | ±0.00 | +0.01 | +0.02 | +0.02 | +0.08 |
| Residual silver (μg/$m^2$) | | 2.3 | 1.1 | 1.3 | 2.0 | 3.3 | 3.9 | 9.8 |
| Sensitization Streaks | | ○ | ○ | ○ | Δ | Δ | Δ | XX |

| | | Processing I Example | | | | | |
|---|---|---|---|---|---|---|---|
| | | 15 | 16 | 17 | 18 | 19 | 20 |
| Coating Sample | | H | I | I | I | H | H |
| Replenishment Solution | | (d) | (a) | (b) | (d) | (a) | (a) |
| Replenishment quantity (per 1 $m^2$ of photosensitive material) | | 30 ml | 300 ml | 200 ml | 30 ml | 300 ml | 300 ml |
| Development Solution | Tank Solution | $2.0 \times 10^{-1}$ | $5.4 \times 10^{-2}$ | $5.4 \times 10^{-2}$ | $2.0 \times 10^{-1}$ | $5.4 \times 10^{-2}$ | $5.4 \times 10^{-2}$ |
| Chloride Ion Concentration (mol/l) | Replenishment Solution | $6.0 \times 10^{-2}$ | $4.0 \times 10^{-2}$ | $3.3 \times 10^{-2}$ | $6.0 \times 10^{-2}$ | $4.0 \times 10^{-2}$ | $4.0 \times 10^{-2}$ |
| Development Solution | Tank Solution | $1.7 \times 10^{-3}$ | $1.7 \times 10^{-3}$ | $5.9 \times 10^{-3}$ | $3.6 \times 10^{-4}$ | $1.7 \times 10^{-3}$ | $5.9 \times 10^{-3}$ |
| Bromide Ion Concentration (mol/l) | Replenishment Solution | $1.5 \times 10^{-3}$ | $1.7 \times 10^{-3}$ | $5.9 \times 10^{-3}$ | — | $1.7 \times 10^{-3}$ | $5.9 \times 10^{-3}$ |
| Remarks | | Comparison Example | Comparison Example | Comparison Example | Comparison Example | Comparison Example | Comparison Example |
| At start | BL Dmax | 1.70 | 1.84 | 1.66 | 1.90 | 1.80 | 1.62 |
| | BL Dmin | 0.07 | 0.07 | 0.07 | 0.08 | 0.07 | 0.07 |
| BL ΔDmin (Value at end minus value at start) | | +0.04 | +0.01 | +0.01 | +0.05 | +0.02 | +0.01 |
| Residual silver (μg/$m^2$) | | 8.9 | 10.0 | 10.6 | 6.9 | 5.0 | 8.1 |
| Sensitization Streaks | | Δ | Δ | ○ | Δ | Δ | Δ |

It is seen from Table 6 that in processing examples (1) to (13) in which processing was effected with development solutions of the invention gave good results, since the photographic characteristics were excellent; the maximum density was high and the minimum density was low, and continuous processing was accompanied by hardly any increase in the minimum density.

With the examples of the invention, when the development solution's chlorine ion concentration was $4\times10^{-2}$ to $1\times10^{-1}$ mol/l and its bromine ion concentration was $5\times10^{-5}$ to $5\times10^{-4}$ mol/l, the results were better in respect of the maximum density, increase in the minimum density during running processing and the amount of residual silver, as seen in processing examples (1) to (8).

Again with the examples of the invention, when the photosensitive material's coated silver content was 0.8 g/m$^2$ or less as in processing examples (9) to (13) the results in respect of the maximum density, increase in the minimum density during running processing and the amount of residual silver and occurrence of sensitization streaks were still better, and they were even better when the amount of coated silver was 0.75 g/m$^2$ or less.

As seen in processing examples (14) to (20), when the chlorine ion concentration and bromine ion concentration were lower than the concentrations of the invention, although the maximum density was high there was a great increase in the minimum density during running processing and there was a great amount of residual silver and marked occurrence of sensitization streaks. In cases where either the chlorine ion or bromine ion concentration was higher than the concentration of the invention, a loss of maximum density and an increase in the amount of residual silver.

Making a direct comparison for the same photo sensitive material and replenishment quantity, the results in processing examples (5), (14), (19) and (20) clearly show that combinations of chlorine ion and bromine ion concentrations of the invention provided excellent results.

EXAMPLE 9

The same procedure as in Example 8 was followed, except that in processing example (1), I-1, I-2, I-3, II-2, II-1, II-5, II-9, II-13 and II-20 were used instead of organic preservative A II-19. Similarly good results were obtained.

EXAMPLE 10

The same procedure as in Example 8 was followed, except that in processing stage (1) III-3, III-11, IV-1 and IV-7 were used instead of triethanolamine in the development solution. Similarly good results were obtained.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photosensitive material which comprises developing a color photographic light-sensitive material comprising a support having thereon having at least one light-sensitive silver halide emulsion layer containing a silver halide comprising at least 98 mol % silver chloride;

in a color developer solution comprising a primary amine color developing agent, and having a chloride concentration of from $4\times10^{-2}$ to $1\times10^{-1}$ mol/l, and a bromide ion concentration of from $5.0\times10^{-5}$ to $5\times10^{-4}$ mol/l.

2. The method as claimed in claim 1, wherein said developer solution comprises from 0.005 to 0.5 mol/l of an organic preservative represented by formulae (I) or (II):

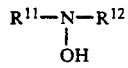

(I)

wherein $R^{11}$ and $R^{12}$ each represents hydrogen, an unsubstituted or substituted alkyl group, an unsubstituted or substituted alkenyl group, an unsubstituted or substituted aryl group or a substituted or unsubstituted heteroaromatic group, provided that at least one of $R^{11}$ and $R^{12}$ is a group other than hydrogen, and $R^{11}$ and $R^{12}$ may be linked to form a saturated or unsaturated 5-membered or 6-membered heterocyclic ring; and

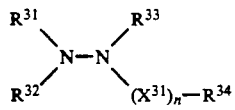

(II)

wherein $R^{31}$, $R^{32}$ and $R^{33}$ each represents hydrogen, a substituted or unsubstituted alkyl group, a substituted or unsubstituted aryl group, or a substituted or unsubstituted heterocyclic group; $R^{34}$ represents a hydroxyl group, a hydroxyamino group, a substituted or unsubstituted alkyl group, a substituted or unsubstituted aryl group, a substituted or unsubstituted heterocyclic group, a substituted or unsubstituted alkoxy group, a substituted or unsubstituted aryloxy group, a substituted or unsubstituted carbamoyl group or a substituted or unsubstituted amino group; $X^{31}$ represents —CO—, —$SO_2$— or —C(=NH)—; and n is 0 or 1; provided that when n is 0, $R^{34}$ represents an alkyl group, aryl group or heterocyclic group; and $R^{33}$ and $R^{34}$ may be linked to form a heterocyclic ring.

3. The method as claimed in claim 2, wherein $R^{11}$ and $R^{12}$ each represents a substituted or unsubstituted alkyl group containing 1 to 10 carbon atoms or a substituted or unsubstituted alkenyl group containing 1 to 10 carbon atoms, each said substituted group being substituted with a substituent selected from the group consisting of a hydroxyl group, an alkoxy group, an alkylsulfonyl group, an arylsulfonyl group, an amido group, a carboxyl group, a cyano group, a sulfo group, a nitro group and an amino group.

4. The method as claimed in claim 3, wherein said alkyl group and alkenyl group represented by $R^{11}$ and $R^{12}$ each contains 1 to 5 carbon atoms.

5. The method as claimed in claim 2, wherein each of $R^{31}$, $R^{32}$ and $R^{33}$ represents hydrogen or a substituted or unsubstituted alkyl group containing 1 to 10 carbon atoms; $R^{34}$ represents a substituted or unsubstituted alkyl group, a substituted or unsubstituted aryl group, a substituted or unsubstituted alkoxy group, a substituted or unsubstituted carbamoyl group, or a substituted or unsubstituted amino group; each said substituted group being substituted with at least one substituent selected from the group consisting of a carboxyl group, a sulfo group, a nitro group, an amino group and a phosphono group; and $X^{31}$ represents —CO— or —$SO_2$—.

6. The method as claimed in claim 5, wherein $R^{31}$ and $R^{32}$ each represents hydrogen; $R^{34}$ represents a substituted or unsubstituted alkyl group; and $X^{31}$ represents —CO—.

7. The method as claimed in claim 1, wherein said color developer solution contains substantially no sulfite ions.

8. The method as claimed in claim 1, wherein said color development step is performed at a temperature of 30° to 40° C. for a developing time of 30 seconds to 2 minutes.

9. The method as claimed in claim 8, wherein the total processing time from the first contact of said color light-sensitive material with said developer solution until said light-sensitive material is removed from a final bath is at most 4 minutes.

10. The method as claimed in claim 1, wherein said light-sensitive silver halide emulsion layer contains at most 0.80 g/m$^2$ of silver in said silver halide.

11. The method as claimed in claim 10, wherein said light-sensitive silver halide emulsion layer contains at most 0.75 g/m$^2$ of silver in said silver halide.

12. The method as claimed in claim 11, wherein said light-sensitive silver halide emulsion layer contains from 0.3 to 0.65 g/m$^2$ of silver in said silver halide.

13. The method as claimed in claim 1, wherein said color developer solution is substantially free from benzyl alcohol.

14. The method as claimed in claim 1, wherein said light-sensitive silver halide emulsion layer further comprises a pyrazoloazole coupler; at least one compound represented by formula (FI) or (FII); and at least one compound represented by formula (GI):

$$R_1-(A)_n-X \qquad \text{(FI)}$$

$$R_2-\underset{\underset{B}{|}}{C}-Y \qquad \text{(FII)}$$

wherein $R^1$ and $R^2$ each represents an aliphatic group, an aromatic group or a heterocyclic group; n is 1 or 0; A represents a group capable of forming a chemical bond by reacting with a primary aromatic amine developing agent; X represents a group which is eliminated upon said reaction of A with said primary aromatic amine developing agent; B represents hydrogen, an aliphatic group, an aromatic group, a heterocyclic group, an acyl group or a sulfonyl group; and Y represents a group capable of accelerating the addition of said aromatic amine developing agent to said compound represented by formula (FII), provided that $R_1$ and X, Y and $R_2$ or Y and B may be linked to form a cyclic structure; and $$R-Z \qquad \text{(GI)}$$

wherein R represents an aliphatic group, an aromatic group or a heterocyclic group; and Z represents a a nucleophilic group or a group which is decomposed in said photosensitive material after development to release a nucleophilic group.

* * * * *